US010535919B2

(12) United States Patent
Linn et al.

(10) Patent No.: US 10,535,919 B2
(45) Date of Patent: Jan. 14, 2020

(54) LOW-PROFILE COMMUNICATION TERMINAL AND METHOD OF PROVIDING SAME

(71) Applicants: Steven Linn, Hillsboro, OR (US); Stephen Olfert, Kent, WA (US); Jason Vice, Snohomish, WA (US); Mike Slota, Kirkland, WA (US); Robert Morey, Sammamish, WA (US); Colin Stuart Short, Redmond, WA (US)

(72) Inventors: Steven Linn, Hillsboro, OR (US); Stephen Olfert, Kent, WA (US); Jason Vice, Snohomish, WA (US); Mike Slota, Kirkland, WA (US); Robert Morey, Sammamish, WA (US); Colin Stuart Short, Redmond, WA (US)

(73) Assignee: KYMETA CORPORATION, Redmond, WA (US)

( * ) Notice: Subject to any disclaimer, the term of this patent is extended or adjusted under 35 U.S.C. 154(b) by 215 days.

(21) Appl. No.: 15/601,859

(22) Filed: May 22, 2017

(65) Prior Publication Data

US 2017/0346176 A1 Nov. 30, 2017

Related U.S. Application Data

(60) Provisional application No. 62/340,986, filed on May 24, 2016.

(51) Int. Cl.
*H01Q 1/42* (2006.01)
*H01Q 1/40* (2006.01)
(Continued)

(52) U.S. Cl.
CPC ..... *H01Q 1/42* (2013.01); *H01Q 1/40* (2013.01); *H01Q 1/405* (2013.01); *H01Q 1/424* (2013.01);
(Continued)

(58) Field of Classification Search
CPC ..... H01Q 1/42; H01Q 21/24; H01Q 15/0086; H01Q 1/40; H01Q 15/0066; H01Q 1/405;
(Continued)

(56) References Cited

U.S. PATENT DOCUMENTS 3,296,685 A 1/1967 Suliteanu
3,427,626 A * 2/1969 Losee ..... H01Q 1/42 343/872
6,157,621 A 12/2000 Brown et al.
6,218,995 B1 4/2001 Higgins et al.
(Continued)

OTHER PUBLICATIONS

The International Preliminary Report on Patentability of International Application No. PCT/US2017/034069 dated Dec. 6, 2018, 7 pages.

(Continued)

*Primary Examiner* — Hoang V Nguyen
*Assistant Examiner* — Awat M Salih
(74) *Attorney, Agent, or Firm* — Womble Bond Dickinson (US) LLP

(57) ABSTRACT

Techniques and mechanisms for providing a low-profile terminal for satellite communication. In an embodiment, a communication terminal includes a radome, an array of radio frequency (RF) elements and a foam layer disposed therebetween. The foam layer includes a first side and a second side opposite the first side, wherein the array of RF elements and the radome are coupled to the foam layer via the first side and the second side, respectively. The communication device provides contiguous structure between the radome and the array of RF elements. In another embodiment, the first side forms a machined surface which contributes to flatness of one or more antenna panels having the array of RF elements disposed therein or thereon.

12 Claims, 22 Drawing Sheets

(51) Int. Cl.

| | |
|---|---|
| ***H01Q 15/14*** | (2006.01) |
| ***H01Q 21/06*** | (2006.01) |
| ***H01Q 21/24*** | (2006.01) |
| ***H01Q 15/00*** | (2006.01) |
| ***H01Q 21/00*** | (2006.01) |

(52) U.S. Cl.
CPC ..... *H01Q 15/0066* (2013.01); *H01Q 15/0086* (2013.01); *H01Q 15/14* (2013.01); *H01Q 21/0031* (2013.01); *H01Q 21/061* (2013.01); *H01Q 21/064* (2013.01); *H01Q 21/065* (2013.01); *H01Q 21/24* (2013.01)

(58) Field of Classification Search
CPC .. H01Q 21/0031; H01Q 21/061; H01Q 15/14; H01Q 1/424; H01Q 21/064; H01Q 21/065
See application file for complete search history.

(56) References Cited

U.S. PATENT DOCUMENTS

| | | | | |
|---|---|---|---|---|
| 7,336,241 | B2 | 2/2008 | Bailey et al. | |
| 7,345,632 | B2 | 3/2008 | Smith et al. | |
| 7,450,071 | B1 | 11/2008 | Volman | |
| 8,599,091 | B2 | 12/2013 | Yano | |
| 8,665,174 | B2 | 3/2014 | McCarthy | |
| 2007/0030681 | A1* | 2/2007 | Farrell | B64D 43/00 362/257 |
| 2008/0111741 | A1* | 5/2008 | Lee | G01S 19/37 342/383 |

OTHER PUBLICATIONS

PCT Appln. No. PCT/US2017/034069, International Search Report and Written Opinion, dated May 23 2017, 12 pgs.

* cited by examiner

Iris L2

Iris L1

Patch and Iris L1

Top View

LOW-PROFILE COMMUNICATION TERMINAL AND METHOD OF PROVIDING SAME

CROSS-REFERENCE TO RELATED APPLICATIONS

This application claims the benefit of a U.S. Provisional Application No. 62/340,986 filed on May 24, 2016, the entire contents of which are hereby incorporated by reference herein.

BACKGROUND

1. Technical Field

Embodiments of the invention relate generally to of a phased array antenna and more particularly, but not exclusively, to the coupling of a radome to an antenna panel.

2. Background Art

Existing satellite systems variously provide a bulbous radome which has disposed therein an antenna coupled to be moved by a gimbal. The antenna usually includes a dish mounted on a stand, with the horn pointing in at the dish surface. Traditional Vehicle Mounted Earth Stations (VMESs), even those including various phased array devices, require motorization and mechanical pointing for some portion of their function.

Recent improvements in electronically steerable, beamforming antenna technologies offer the promise of new in-vehicle, on-vehicle and other applications which support, replace or supplement the use of consumer smartphones and on-board cellular technology modules. For at least this reason, there is expected to be an increasing premium placed on incremental improvements to the space efficiency of communication terminals which utilize electronically steerable antenna devices.

BRIEF DESCRIPTION OF THE DRAWINGS

The various embodiments of the present invention are illustrated by way of example, and not by way of limitation, in the figures of the accompanying drawings and in which.

DETAILED DESCRIPTION

Embodiments described herein variously provide tightly integrated structures of a communication terminal which includes contiguous structure between a radome and an array of radio frequency (RF) elements—e.g., wherein the communication device omits any void layer between the radome and the array of RF elements. In conventional satellite communication systems, a radome is separated from antenna structure by an empty volume disposed therebetween. Unless otherwise indicated, "antenna structure" refers to herein to a structure that is to serve as at least part of an antenna—e.g., wherein an antenna structure is an entire antenna or, alternatively, merely a subset of all components of the antenna.

By integrating the elements such that there is no empty volume between the aperture and radome, some embodiments provide for a relatively low-profile (i.e., thinner) communication terminal without excessively sacrificing structural integrity. In some embodiments, the radome may function as a carrier during manufacture of the communication terminal—e.g., wherein the radome is used to move or otherwise position an array of RF elements that are variously disposed in or on one or more antenna panels. An antenna panel may, for example, include a thin-film-transistor (TFT) segment or other planar antenna structure. Although some embodiments are not limited in this regard, some or all such RF elements may be arranged as a structure—referred to herein as "antenna aperture" (also referred to herein as "aperture," for brevity)—which, for example, is disposed around and/or above an input feed.

Figure 1:
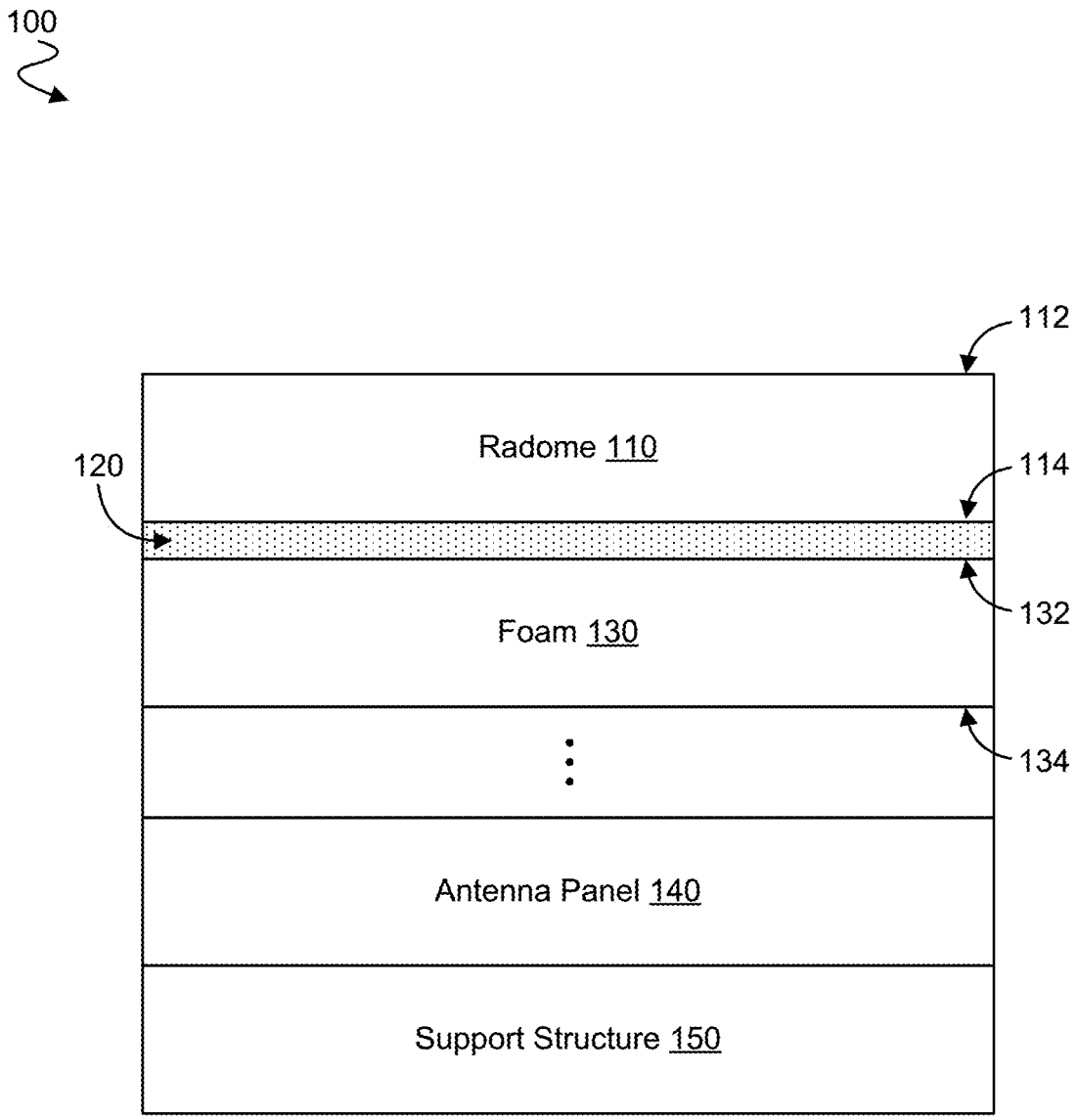
FIG. 1 is a cross-sectional block diagram illustrating elements of a communication device according to an embodiment.

FIG. 1 shows features of a communication device 100 to participate in wireless communications according to an embodiment. Communication device 100 is one example of an embodiment which comprises a radome, an array of radio frequency (RF) elements and a foam layer disposed between the radome and the array of RF elements. The array of RF elements may be coupled to the radome via the foam layer—e.g., where communication device 100 omits any gap layer between the array of RF elements and the radome.

Some embodiments provide a layer of foam which facilitates more efficient fabrication processing—e.g., to improve the handling and/or protection of antenna structures prior to or during assembly with the radome. Alternatively or in addition, providing a layer of foam—e.g., in lieu of a gap layer which is typical in conventional antenna designs—enables a radome to be relatively close to antenna structures, resulting in a thinner (z-dimension) profile of a satellite communication terminal.

In the illustrative embodiment shown, communication device 100 includes a radome 110, a layer of foam 130 and antenna structures (such as the illustrative antenna panel 140 shown) which include an array of RF elements. Although the word "radome" originated as a portmanteau of "radar" and "dome," it will be appreciated that radomes in various embodiments may have any of a variety of curved, or even flat, shapes. It will also be appreciated that embodiments described herein are not limited to the communication of radar signals, but may relate to RF satellite communication, for example.

Radome 110 may be any of a variety of structures that are to propagate RF communications to and/or from antenna panel 140—e.g., where radome 110 is further to provide structural and/or environmental protection of antenna panel 140. For example, radome 110 may comprise one or more dielectric materials—e.g., including any of a variety of plastics adapted from conventional radome designs—that are transparent to, or otherwise transmissive of, RF signals. Radome 110 may, for example, be a solid structure which does not include any porous (e.g., foam) material. Alternatively or in addition, at least a portion of radome 110 which extends over foam 130 may be curved to deviate from a flat plane—e.g., by at least 0.040 inches (and in some embodiments, by at least 0.060 inches). In one embodiment, radome 110 comprises stacked layers (not shown) of different dielectric materials—e.g., the stacked layers having a profile of signal propagation properties which is tuned for communications using antenna panel 140.

Radome 110 may form an exterior surface 112 of communication device 100—e.g., wherein radome 110 forms or is part of a chassis, housing or other enclosure which extends around antenna panel 140. Such an enclosure may be formed by any of a variety of one or more plastic, metal and/or other materials which, for example, are adapted from conventional communication terminal designs. In such an embodiment, antenna panel 140 may be disposed, directly or indirectly, on a lower portion of the enclosure (as represented by the illustrative support structure 150 shown). Support structure 150 may include or alternatively, be disposed under an antenna which includes antenna panel 140. For example, a RF feed structure (not shown) may be coupled to operate some or all RF elements—e.g., wherein the RF feed structure is a component of antenna panel 140, disposed in support structure 150 or disposed between antenna panel 140 and support structure 150.

Antenna panel 140 may provide some or all functionality of an electronically steerable (e.g., beam-forming) antenna. For example, antenna panel 140 may include a substrate—e.g., comprising quartz, glass, polyimide, printed circuit board, etc.—wherein metamaterials, thin-film-transistors (TFTs) and/or other structures variously formed in or on the substrate are configured as an array of elements to perform RF signal transmission and/or reception. Some or all such structures may, for example, be adapted from conventional flat panel array architectures, which are not detailed herein to avoid obscuring certain features of various embodiments. Although some embodiments are not limited in this regard, antenna panel 140 may be one of multiple substrates which, in combination with one another, form an antenna aperture. However, other embodiments are not limited to a particular RF array technology with which antenna panel 140 is to provide an electronically steerable antenna functionality.

As shown in FIG. 1, foam 130 may be coupled, via an adhesive 120, to a side 114 of radome 110 which is opposite side 112. For example, foam 130 may include a side 134 and another side 132 which is opposite side 134, wherein foam 130 is adhered to side 114 of radome 110 via side 132, and wherein foam 130 is further coupled—directly or indirectly—to antenna panel 140 via side 134. Although some embodiments are not limited in this regard, side 134 may form a machined surface of foam 130. For example, fabrication of foam 130 may include cutting (e.g., skiving), grinding and/or other processing with a machine tool to remove foam material for the formation of side 134. In such an embodiment, a machined surface of side 134 may include minute ridges, grooves and/or other indicia of such machining.

Foam 130 may include any of a variety materials that have a dielectric constant in a range of 1.0 to 1.25—e.g., at least for signals of up to 10 GHz. For example, foam 130 may include ROHACELL® 31 HF foam or any of a variety of other ROHACELL® foams from Evonik Industries Aktiengesellschaft of Essen, Germany.

Adhesive 120 may include any of a variety of materials to form an adhesive bond between radome 110 and either antenna panel 140 or any intermediary structure (not shown) that might facilitate coupling to antenna panel 140. In one embodiment, adhesive 120 includes any of a variety of pressure-sensitive adhesive (PSA) materials—e.g., including one or more styrene copolymers, acrylics and/or other materials adapted from conventional PSA products. Alternatively or in addition, adhesive 120 may include one or more materials which cure in response to heat, ultraviolet radiation, air and/or the like—e.g., wherein adhesive 120 is formed from a two-part epoxy adhesive mixture which is deposited just prior to an adhesion of foam 130 and radome 110.

Structures of communication device 100 extending from side 114 to antenna panel 140 may omit any gap layer and form a contiguous stack of materials. One or more materials of such a stack may form any of a variety of flat or curved surfaces, in different embodiments, and are not limited to the illustrative flat sides variously shown in FIG. 1.

In one embodiment, foam 130 adjoins or is otherwise a closest structure to antenna panel 140 at side 134—e.g., other than any adhesive (not shown) that might couple foam 130 and antenna panel 140 to one another. In other embodiments, one or more other structures may be disposed between foam 130 and antenna panel 140. By way of illustration and not limitation, communication device 100 may further comprise one or more layers of structures that promote large angle beam direction and/or other signal propagation characteristics. In some embodiments, communication device 100 further comprises one or more additional layers of foam between foam 130 and antenna panel 140. Such one or more additional foam layers may, for example, include a foam layer which forms at least one machined surface.

Foam 130 may be somewhat thin between sides 132, 134—e.g., as compared to a thickness of radome 110 between sides 112, 114. For example, an average thickness of foam 130 may be equal to or less than 0.060 inches (e.g., wherein such average thickness is equal to or less than 0.040 inches and, in some embodiments, equal to or less than 0.030 inches).

Figure 2:
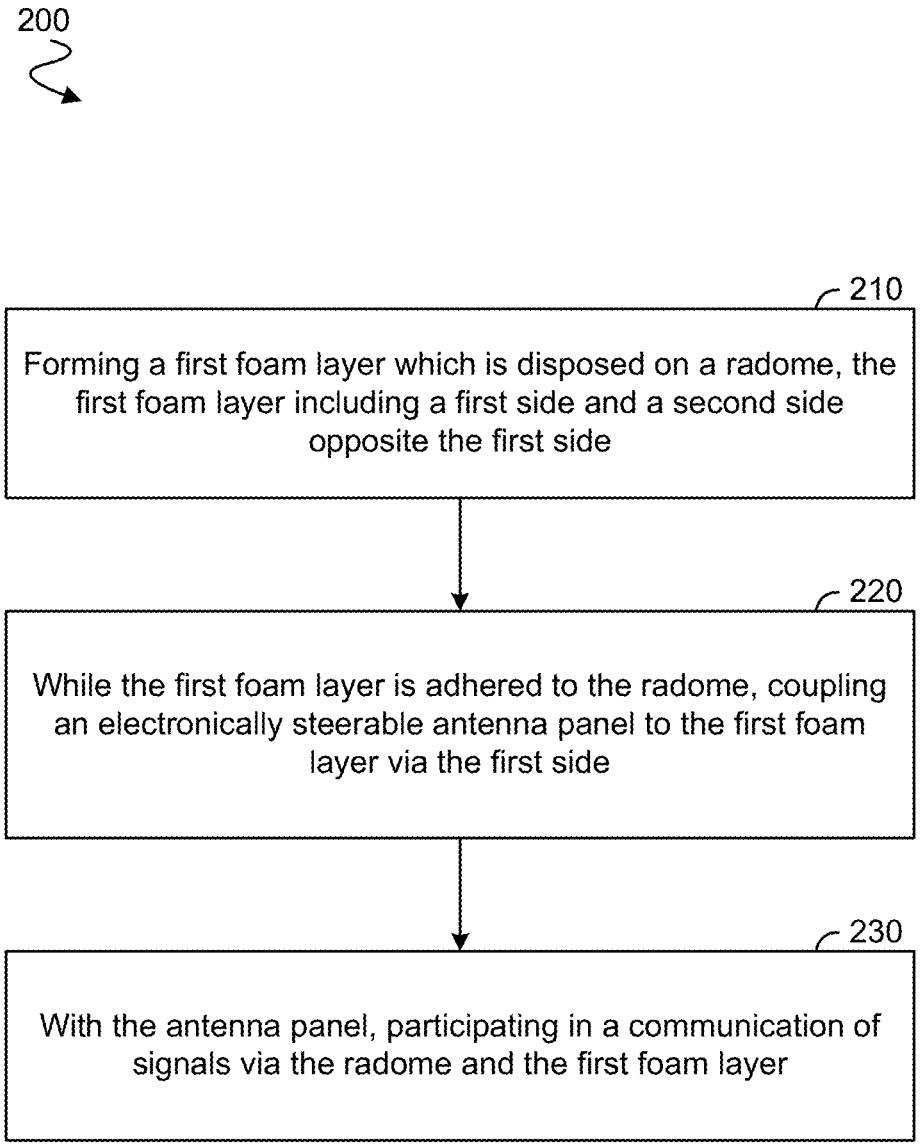
FIG. 2 is a flow diagram illustrating elements of a method for providing functionality of an antenna system according to an embodiment.

FIG. 2 shows features of a method 200 to provide communication functionality of an electrically steerable antenna according to an embodiment. Method 200 is one example of an embodiment which is to provide structures such as those of communication device 100. To illustrate certain features of various embodiments, method 200 is described herein with reference to FIGS. 3A-3C, which show a sequence of processing stages 300-307 to manufacture a communication terminal according to one example embodiment. However, method 200 may be performed, in other embodiments, to provide any of a variety of structures in addition to (or other than) those shown in stages 300-307.

In the example embodiment shown, method 200 includes, at 210, forming a first foam layer which is disposed on a radome. After the forming at 210, the first foam layer may include a first side and a second side opposite (e.g., side 134 and side 132, respectively). The forming at 210 may include depositing a foam material on the radome—e.g., wherein the foam material cures to adhere itself to the radome or wherein a previously-cured foam material is bonded to the radome with an adhesive. For example, method 200 may further comprise adhering the second side of the first foam layer to the radome with a pressure sensitive adhesive material. In some embodiments, the forming at 210 comprises machining the foam material, after deposition on the radome, to form a first machined surface at the first side of the first foam layer.

Figure 3A:
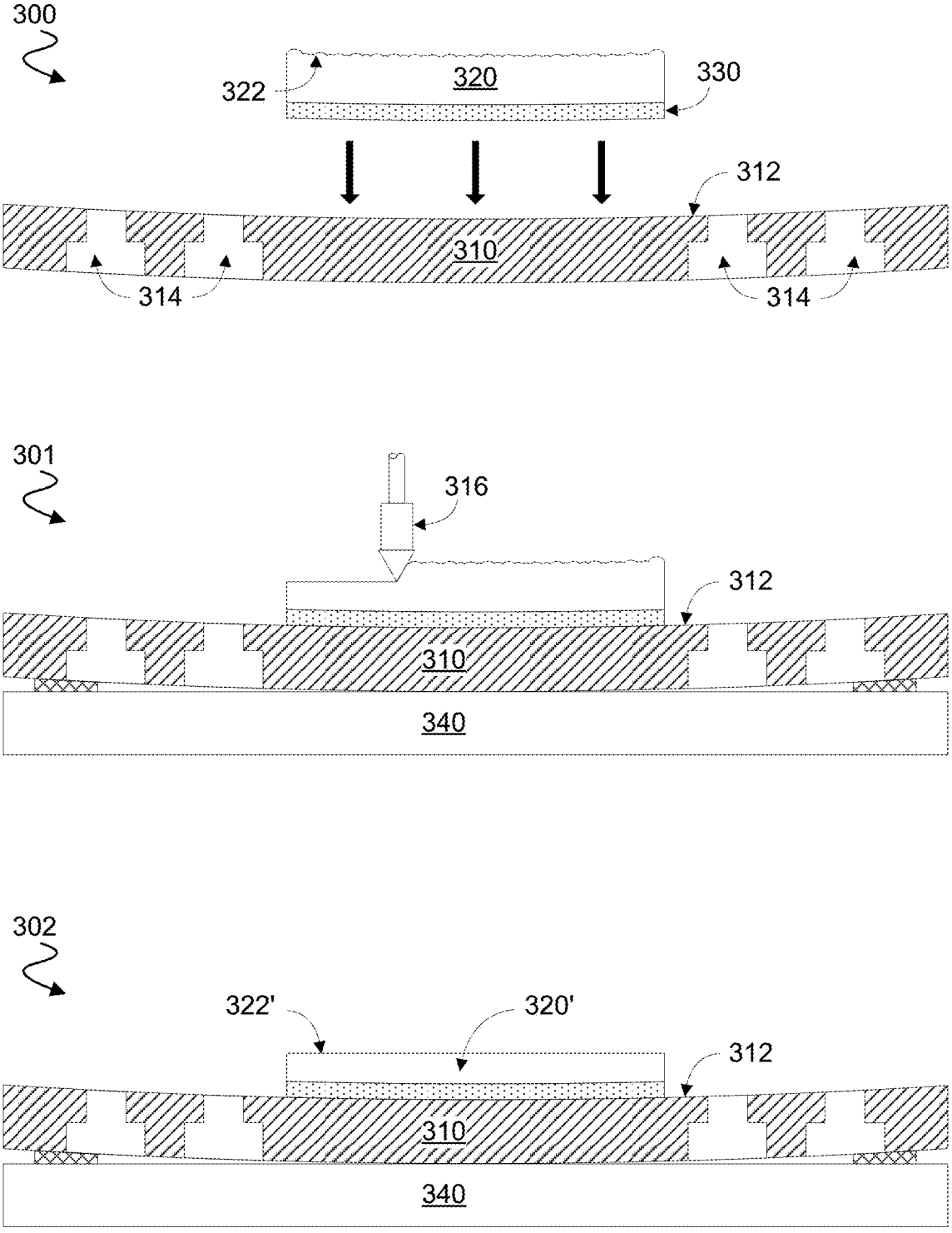
FIGS. 3A-3C are cross-sectional diagrams each illustrating respective stages of a process to manufacture a communication device according to an embodiment.

Referring now to FIG. 3A, a radome 310 may be adhered (at stage 300) to a foam material 320 using a pressure sensitive adhesive 330—e.g., wherein foam material 320 and adhesive 330 are disposed on a side 312 of radome 310. Although some embodiments are not limited in this regard, radome 310 may have formed therein one or more recesses, holes and/or other structures (such as the illustrative through-holes 314 shown) to facilitate coupling with one or more other structures of the communication terminal. Moreover, although side 312 is shown as being curved, radome 310 may instead form one or more flat sides, in various embodiments.

As illustrated at stage 301, a side 322 of foam material 320 may be cut or otherwise processed with a machining tool 316—e.g., where (at stage 302) such processing forms a machined surface 322' of a resulting foam layer 320'. Such machining may be performed to reduce foam thickness and/or because of an uneven, curved or otherwise non-flat surface of side 322. To provide precise control over dimensions, flatness, alignment and/or other features, radome 310 may be secured to a machining table 340 during such machining and/or other processing. This securing may be provided by clamping, vacuum or other mechanisms that resist a shearing force during machining of side 322, while limiting the application of bending forces on radome 310.

Method 200 may further comprise, at 220, coupling an electronically steerable antenna panel to the first foam layer, via the first side, while the first foam layer is adhered to the radome. The coupling at 220 may, for example, include positioning the radome and the first foam layer onto a base structure while the antenna panel is disposed on the base structure. In such an embodiment, the positioning may include abutting a surface of a standoff with the base structure, wherein the standoff is coupled to and extends from the radome.

Figure 3B:
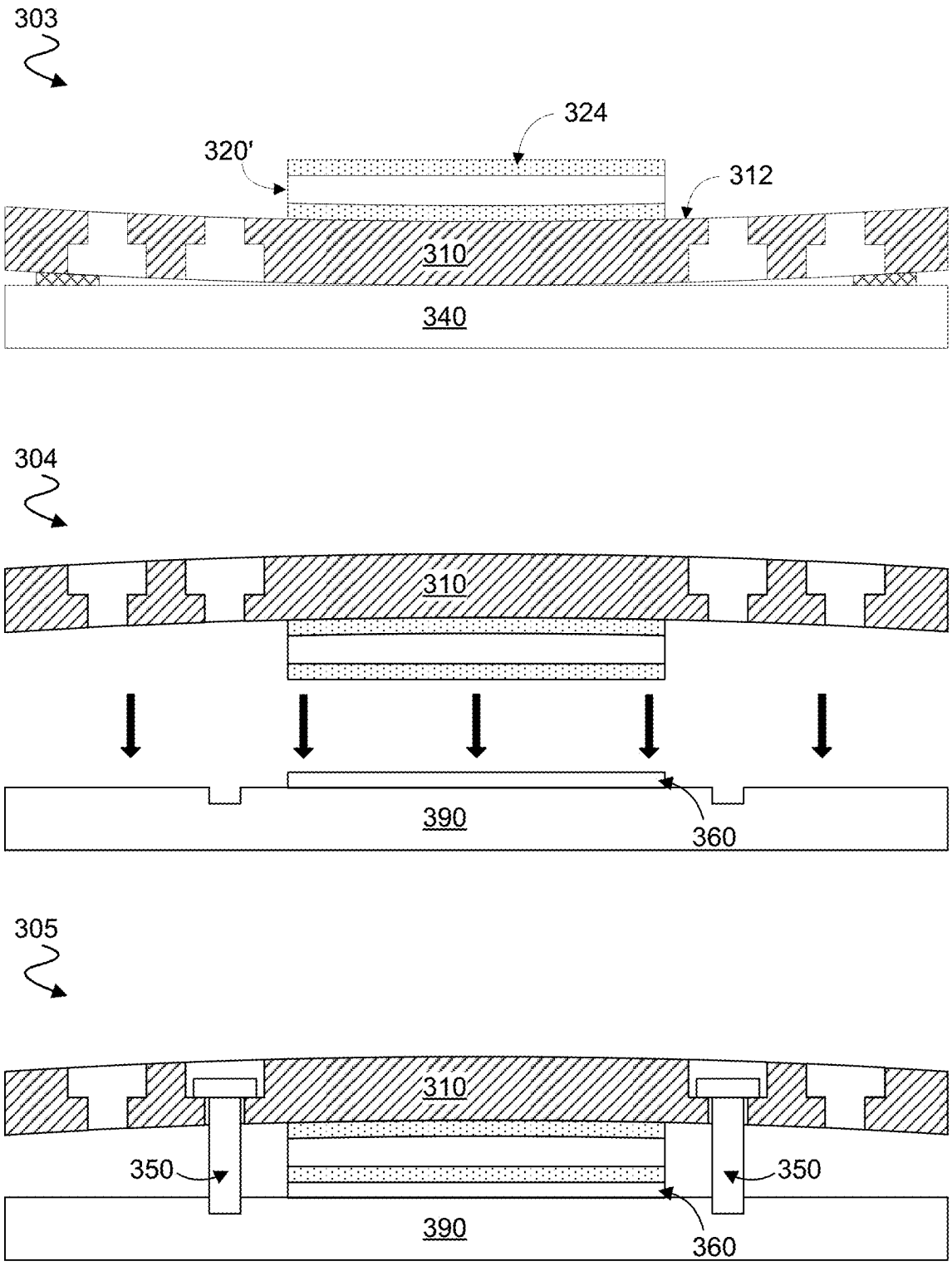

For example, referring now to the stage 303 shown in FIG. 3B, another adhesive 324 (e.g., including the same one or more adhesive materials of adhesive 330) may be disposed on foam layer 320' to form a first assembly that is to be mounted—directly or indirectly—onto one or more antenna structures which include an array of RF elements. As illustrated at stage 304, the first assembly may be removed from machining table 340, inverted, and then aligned over and brought in contact with one or more antenna panels 360 that, for example, are positioned and secured on an alignment table 390. Portions of alignment table 390 may be flat at least to some minimum threshold for required manufacturing tolerances. Alternatively or in addition, alignment table 390 may have formed therein one or more holes, posts and/or other alignment structures to facilitate alignment of the one or more antenna panels 360 relative to the first assembly formed at stage 303.

By way of illustration and not limitation, as shown at stage 305, multiple alignment structures (e.g., including the illustrative posts 350 shown) may variously extend through a level in which one or more antenna panels 360 are disposed—e.g., wherein some or all such alignment structures are variously positioned around a periphery of the one or more antenna panels 360. In the example embodiment shown, posts 350 function may facilitate x-y plane alignment at least between some of through holes 314 and corresponding holes (or other fiducial structures) of alignment table 390. Alternatively or in addition, posts 350 may function as standoffs which limit an extent to which one or more structures may be subsequently brought into z-axis proximity with one or more antenna panels 360. In such an embodiment, some or all of posts 350 may be variously epoxied, threaded and/or otherwise affixed to radome 310.

Figure 3C:
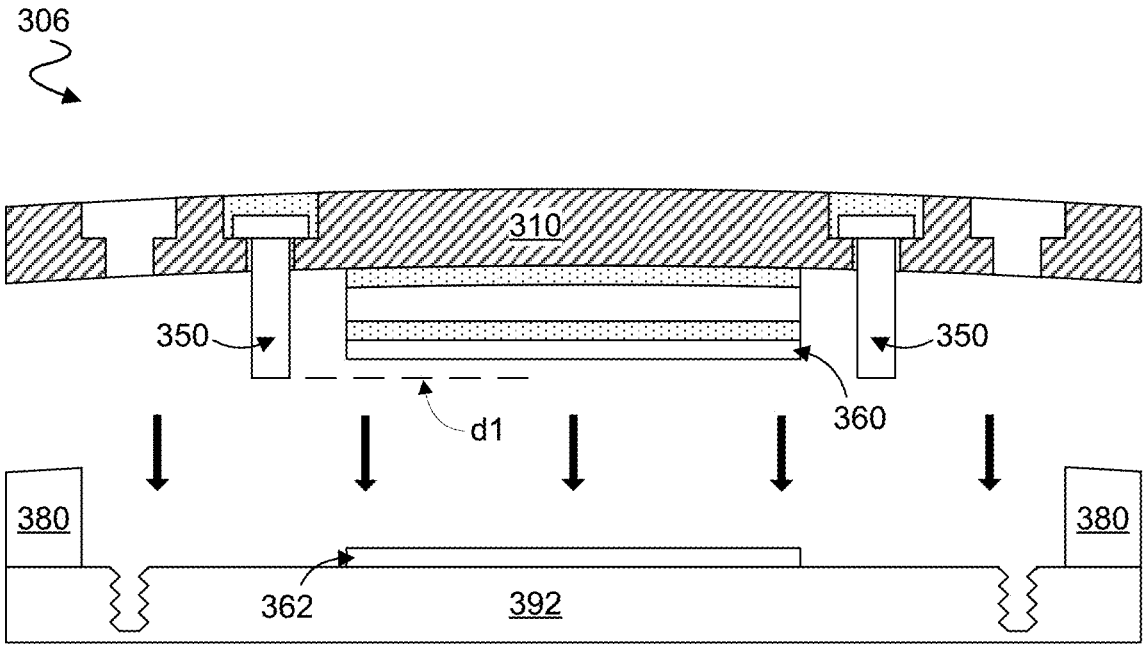
Figure 3C:
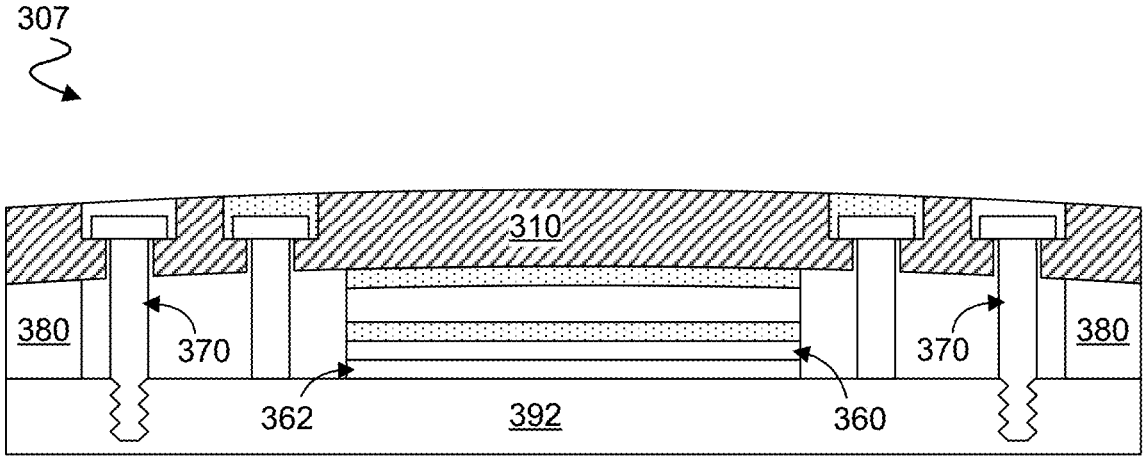

Referring now to FIG. 3C, a second assembly (including the first assembly, one or more antenna panels 360 and posts 350) formed at stage 305 may be removed from alignment table 390 and coupled with one or more other structures which are to be included in the communication terminal. By way of illustration and not limitation, the second assembly may, at stage 306, be aligned over a base 392 (e.g., providing support structure 150) and adjoining sidewall structures 380.

In the example embodiment shown, base 392 includes threaded holes to facilitate coupling of the second assembly thereto. As shown at stage 307, screws 370 may be variously inserted through respective ones of the holes 314 in radome 310, the screws 370 to be coupled each with a respective threaded hole of base 392. Base 392 may include or otherwise accommodate any of a variety of additional or alternative structures to facilitate direct or indirect coupling with the second assembly. In such an embodiment, posts 350 may variously abut with a surface of base 392, whereby posts 350 assure that at least some minimum required z-axis distance (d1) is kept between one or more antenna panels 360 and said surface of base 392. Although shown as variously abutting respective flat surface regions of base 392, one or more of posts 350 may alternatively abut respective recessed surfaces of base 392—e.g., wherein base 392 forms holes and/or other features which, in combination with posts 350, facilitate three-dimensional alignment and positioning of the second assembly relative to base 392.

The distance d1 may allow for sufficient room to accommodate one or more structures (e.g., including the illustrative RF feed structure 362 shown). For example, distance d1 may assure that pressure applied using screws 370 does not result in damage to one or more panels 360, RF feed structure 362 and/or other structures between base 392 and radome 310. Alternatively or in addition, deformability of foam layer 320' (and/or other foam layers disposed on one or more antenna panels 360) may mitigate structural damage by enabling compression stresses to be distributed across a wider area. In some embodiments, base 392 itself includes RF feed structure 362 and/or other antenna structure.

The processing illustrated by stages 300-306 is merely one example of an embodiment wherein a radome and an antenna are fixed relative to one another via contiguous structure including a foam material, wherein standoffs are provided to facilitate correct positioning of at least some antenna structure relative to other structure which is to provide structural support for that antenna structure. Such other structure may be coupled to the antenna or, alternatively, may be or otherwise include additional antenna structure.

In utilizing standoff structures, some embodiments accommodate variation, across the plane of base 392, in a vertical distance between a bottom of radome 310 and a top of base 392. For example, standoffs can be placed at a multitude of positions around a periphery of one or more antenna panels 360, where the standoffs are fixed in place such that respective bottoms of the standoffs are to be in the same plane as the top of base 392. Such positioning of the standoffs may mitigate cant and warpage of radome 310 which might otherwise be caused by the fastening of radome 310 to base 392. As a result, stresses on one or more antenna panels 360 may be prevented or otherwise reduced. Such standoff positioning may assure that an iris metal plane of an aperture (formed by one or more antenna panels 360) is in parallel with the various other planes of materials of an RF feed. Alternatively or in addition, the standoffs may facilitate improved z-axis (height) positioning of the iris metal plane above an RF feed or other underlying structure—e.g., even if an air gap is located below the iris.

In some embodiments, the coupling at 220 includes coupling the antenna panel to the first foam layer via one or more other structures. For example, such one or more other structures may include layers variously coupled each to the first foam layer via the first side, wherein coupling the electronically steerable antenna panel includes coupling the electronically steerable antenna panel to the first foam layer via the layers. The layers may facilitate signal shaping, beam direction and/or the like.

Although some embodiments are not limited in this regard, method 200 may additionally or alternatively include operation of a communication device such as one provided by the forming at 210 and coupling at 220. For example, method 200 may include, at 230, participating, with the antenna panel, in a communication of signals which are propagated via the radome and the first foam layer.

Figure 4:
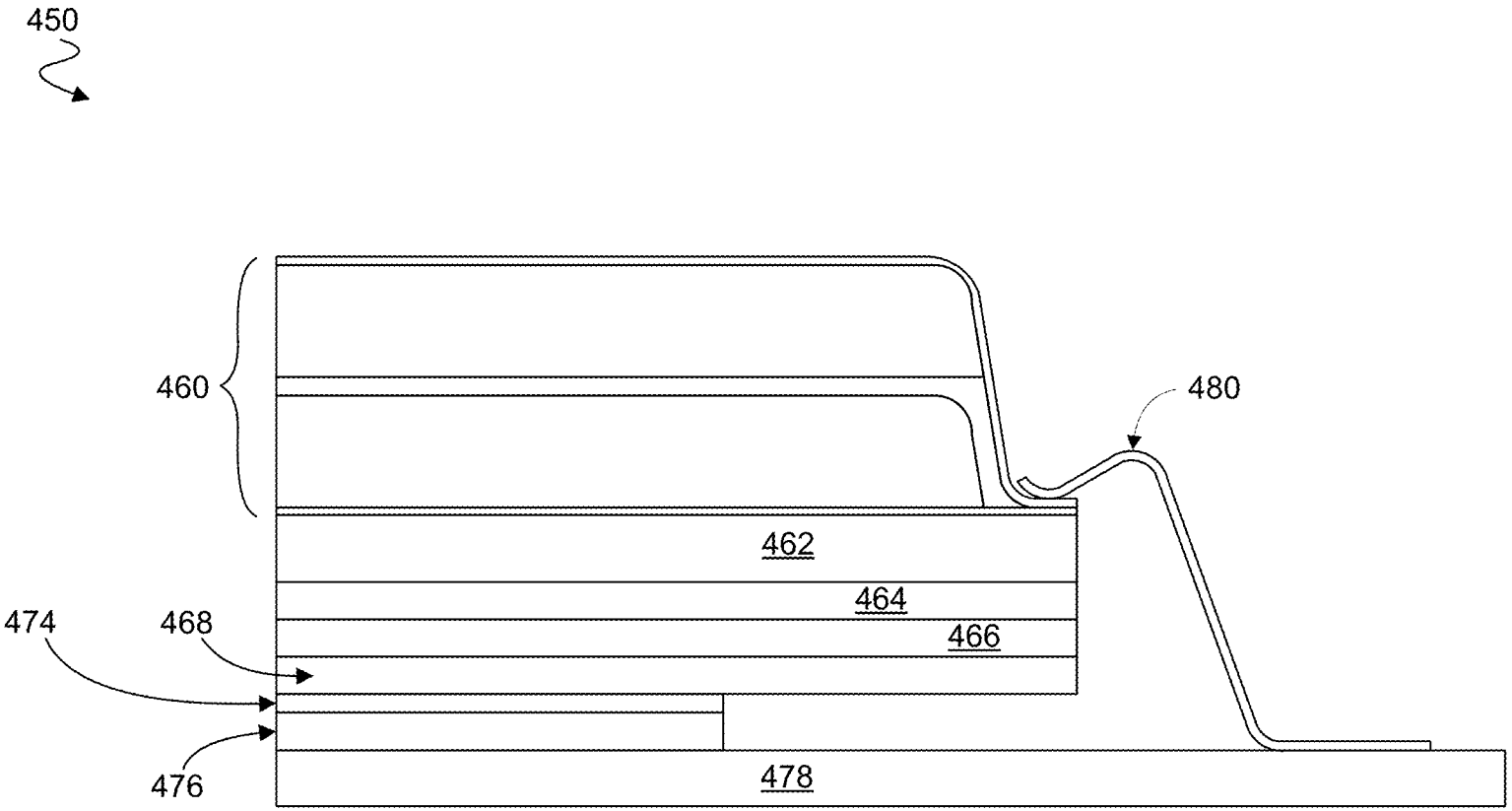
FIG. 4 is a cross-sectional diagram illustrating elements of a communication device according to an embodiment.

FIG. 4 shows features of a communication device 450 to provide functionality of an electrically steerable antenna according to another embodiment. Communication device 450 may include some or all of the features of communication device 100—e.g., where functionality of communication device 450 is provided according to processes of method 200.

Communication device 450 is another example of an embodiment wherein RF elements are coupled only indirectly to a foam layer (and, in turn, to a radome)—e.g., wherein communication device 450 omits any gap layer between the RF elements and the foam layer. In the example embodiment shown, communication device 450 includes a radome 460, a foam layer 462 and antenna panels 474 having respective RF elements (not shown) variously disposed therein or thereon. Radome 460 may include stacked layers of dielectric materials which, in combination with each other, provide tuned signal propagation characteristics.

Antenna panels 474 may be disposed over a RF feed structure 476 which, in turn, is supported by a base 478—e.g., the RF feed structure 476 to further propagate signals to and/or from antenna panels 474. In the illustrative embodiment shown, a stack disposed between antenna panels 474 and foam layer 462 includes a foam layer 466 and other layers 464, 468 that, for example, aid in large angle beam direction and/or other signal propagation characteristics. However, such a stack may include any of a variety of other arrangements of more, fewer and/or different layered structures, in various embodiments. A clasp 480 and/or other fastener hardware may be coupled to base 478, wherein clasp 480 secures radome 460 onto foam layer 462, the stack, antenna panels 474 and RF feed structure 476. In other embodiments, base 478 itself includes RF feed structure 476 and/or other antenna structure.

Embodiments of flat panel antennas are disclosed. The flat panel antennas include one or more arrays of antenna elements on an antenna aperture. In one embodiment, the antenna elements comprises liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Figure 5A:
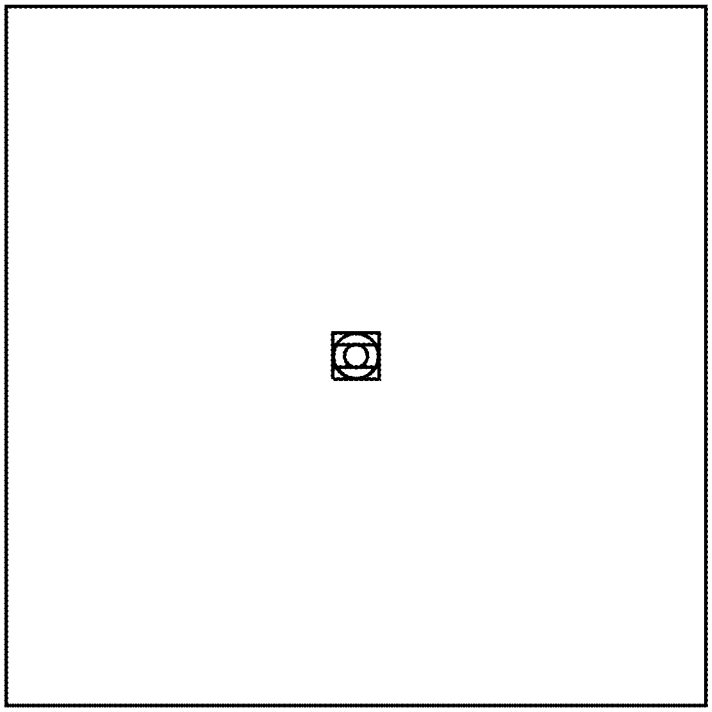
FIG. 5A illustrates a top view of one embodiment of a coaxial feed that is used to provide a cylindrical wave feed.

FIG. 5A illustrates a top view of one embodiment of a coaxial feed that is used to provide a cylindrical wave feed. The coaxial feed structures shown in FIG. 5A may, for example, provide functionality of antenna panel 140 or other antenna structures described herein. Referring to FIG. 5A, the coaxial feed includes a center conductor and an outer conductor. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

Figure 5B:
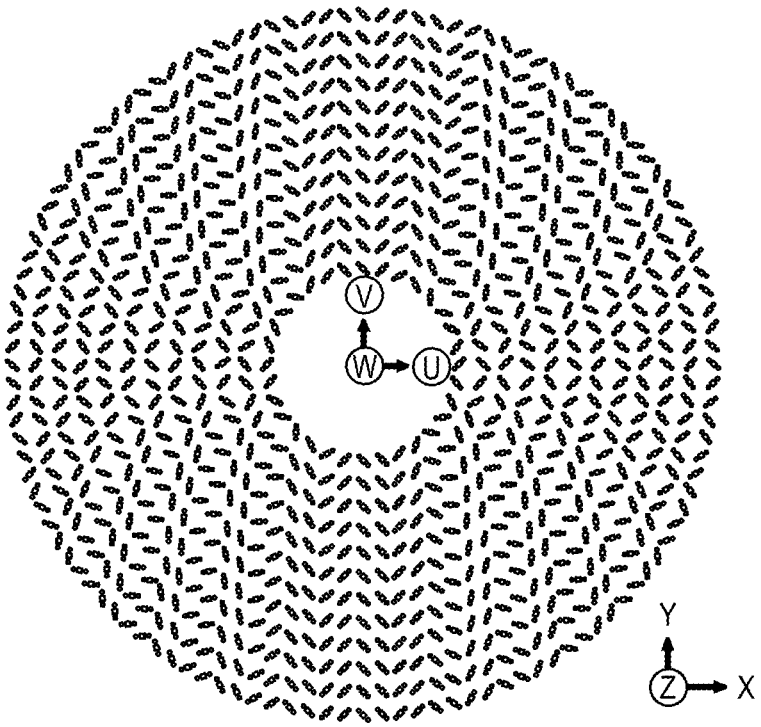
FIG. 5B illustrates an aperture having one or more arrays of antenna elements placed in concentric rings around an input feed of the cylindrically fed antenna.

FIG. 5B illustrates an aperture having one or more arrays of antenna elements placed in concentric rings around an input feed of the cylindrically fed antenna.

In one embodiment, the antenna elements comprise a group of patch and slot antennas (unit cells). This group of unit cells comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch and intermediate states between on and off for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty five degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides as described above.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, a matrix drive is used to apply voltage to the patches in order to drive each cell separately from all the other cells without having a separate connection for each cell (direct drive). Because of the high density of elements, the matrix drive is the most efficient way to address each cell individually.

In one embodiment, the control structure for the antenna system has 2 main components: the controller, which includes drive electronics for the antenna system, is below the wave scattering structure, while the matrix drive switching array is interspersed throughout the radiating RF array in such a way as to not interfere with the radiation. In one embodiment, the drive electronics for the antenna system comprise commercial off-the-shelf LCD controls used in commercial television appliances that adjust the bias voltage for each scattering element by adjusting the amplitude of an AC bias signal to that element.

In one embodiment, the controller also contains a microprocessor executing software. The control structure may also incorporate sensors (e.g., a GPS receiver, a three axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the controller controls which elements are turned off and which elements are turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low-profile, especially when compared to conventional satellite dish receivers.

Figure 6:
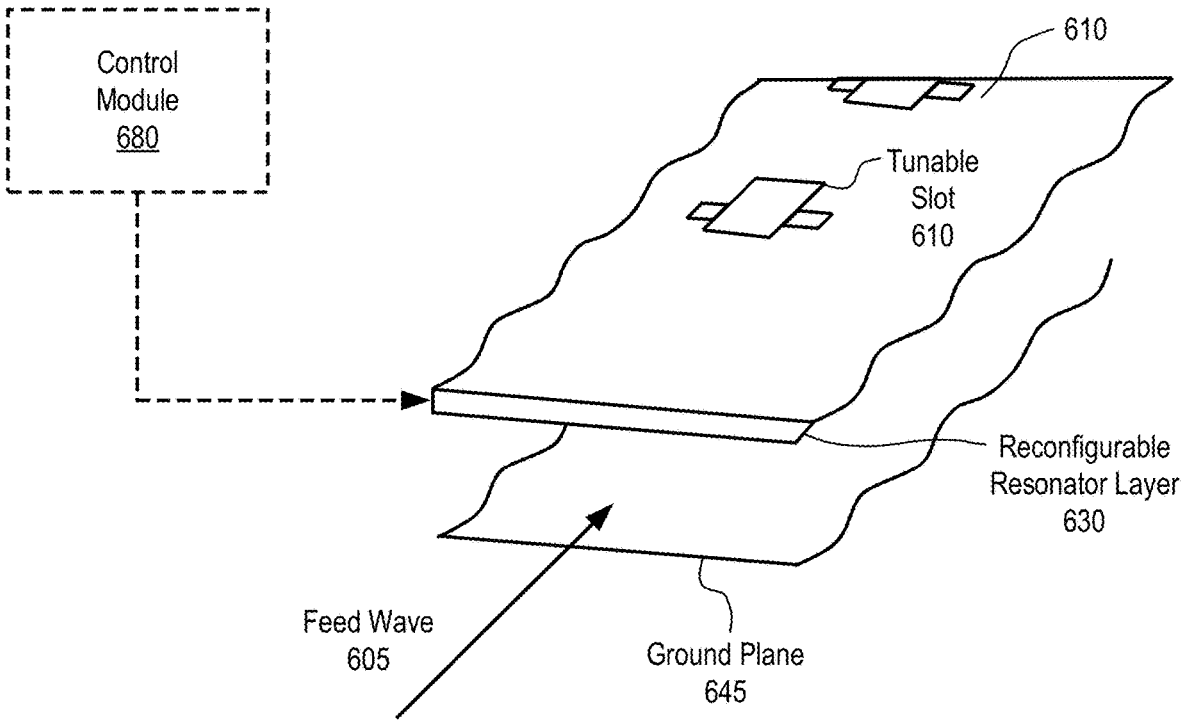
FIG. 6 illustrates a perspective view of one row of antenna elements that includes a ground plane and a reconfigurable resonator layer.

FIG. 6 illustrates a perspective view of one row of antenna elements that includes a ground plane and a reconfigurable resonator layer. The arrangement of antenna elements shown in FIG. 6 may, for example, provide functionality of antenna panel 140 or other antenna structures described herein. Reconfigurable resonator layer 630 includes an array of tunable slots 610. The array of tunable slots 610 can be configured to point the antenna in a desired direction. Each of the tunable slots can be tuned/adjusted by varying a voltage across the liquid crystal.

Control module 680 is coupled to reconfigurable resonator layer 630 to modulate the array of tunable slots 610 by varying the voltage across the liquid crystal in FIG. 6. Control module 680 may include a Field Programmable Gate Array ("FPGA"), a microprocessor, a controller, System-on-a-Chip (SoC), or other processing logic. In one embodiment, control module 680 includes logic circuitry (e.g., multiplexer) to drive the array of tunable slots 610. In one embodiment, control module 680 receives data that includes specifications for a holographic diffraction pattern to be driven onto the array of tunable slots 610. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 680 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 605 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 610 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by w_hologram=w_in^*w_out, with w_in as the wave equation in the waveguide and w_out the wave equation on the outgoing wave.

Figure 7:
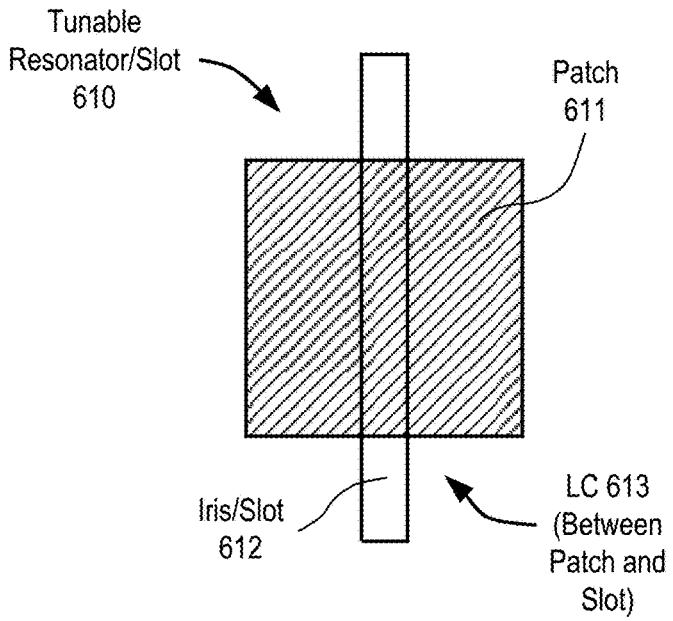
FIG. 7 illustrates one embodiment of a tunable resonator/slot.

FIG. 7 illustrates one embodiment of a tunable resonator/slot 610. Tunable slot 610 includes an iris/slot 612, a radiating patch 611, and liquid crystal 613 disposed between iris 612 and patch 611. In one embodiment, radiating patch 611 is co-located with iris 612.

Figure 8:
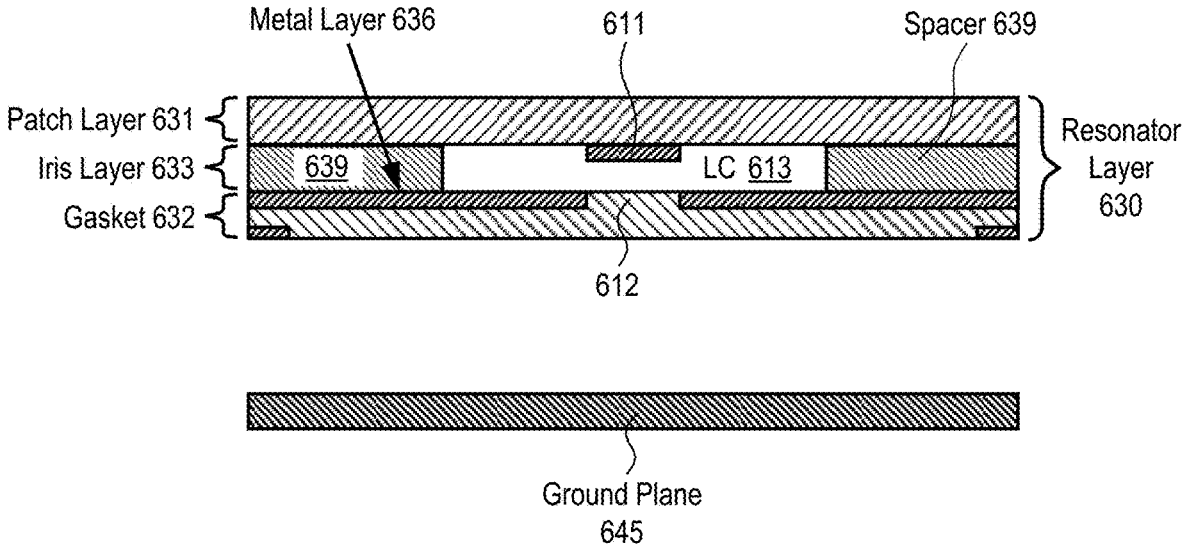
FIG. 8 illustrates a cross section view of one embodiment of a physical antenna aperture.

FIG. 8 illustrates a cross section view of a physical antenna aperture, in accordance with an embodiment of the disclosure. The antenna aperture includes ground plane 645, and a metal layer 636 within iris layer 633, which is included in reconfigurable resonator layer 630. In one embodiment, the antenna aperture of FIG. 8 includes a plurality of tunable resonator/slots 610 of FIG. 7. Iris/slot 612 is defined by openings in metal layer 636. A feed wave, such as feed wave 605 of FIG. 6, may have a microwave frequency compatible with satellite communication channels. The feed wave propagates between ground plane 645 and resonator layer 630.

Reconfigurable resonator layer 630 also includes gasket layer 632 and patch layer 631. Gasket layer 632 is disposed between patch layer 631 and iris layer 633. Note that in one embodiment, a spacer could replace gasket layer 632. In one embodiment, iris layer 633 is a printed circuit board ("PCB") that includes a copper layer as metal layer 636. In one embodiment, iris layer 633 is glass. Iris layer 633 may be other types of substrates.

Openings may be etched in the copper layer to form slots 612. In one embodiment, iris layer 633 is conductively coupled by a conductive bonding layer to another structure (e.g., a RF feed structure) in FIG. 8. Note that in an embodiment the iris layer is not conductively coupled by a conductive bonding layer and is instead interfaced with a non-conducting bonding layer.

Patch layer 631 may also be a PCB that includes metal as radiating patches 611. In one embodiment, gasket layer 632 includes spacers 639 that provide a mechanical standoff to define the dimension between metal layer 636 and patch 611. In one embodiment, the spacers are 75 microns, but other sizes may be used (e.g., 3-200 mm). As mentioned above, in one embodiment, the antenna aperture of FIG. 8 includes multiple tunable resonator/slots, such as tunable resonator/slot 610 includes patch 611, liquid crystal 613, and iris 612 of FIG. 7. The chamber for liquid crystal 613 is defined by spacers 639, iris layer 633 and metal layer 636. When the chamber is filled with liquid crystal, patch layer 631 can be laminated onto spacers 639 to seal liquid crystal within resonator layer 630.

A voltage between patch layer 631 and iris layer 633 can be modulated to tune the liquid crystal in the gap between the patch and the slots (e.g., tunable resonator/slot 610). Adjusting the voltage across liquid crystal 613 varies the capacitance of a slot (e.g., tunable resonator/slot 610). Accordingly, the reactance of a slot (e.g., tunable resonator/slot 610) can be varied by changing the capacitance. Resonant frequency of slot 610 also changes according to the equation $f=1/(2\pi\sqrt{LC})$ where f is the resonant frequency of slot 610 and L and C are the inductance and capacitance of slot 610, respectively. The resonant frequency of slot 610 affects the energy radiated from feed wave 605 propagating through the RF feed structure. As an example, if feed wave 605 is 20 GHz, the resonant frequency of a slot 610 may be adjusted (by varying the capacitance) to 17 GHz so that the slot 610 couples substantially no energy from feed wave 605. Or, the resonant frequency of a slot 610 may be adjusted to 20 GHz so that the slot 610 couples energy from feed wave 605 and radiates that energy into free space. Although the examples given are binary (fully radiating or not radiating at all), full grey scale control of the reactance, and therefore the resonant frequency of slot 610 is possible with voltage variance over a multi-valued range. Hence, the energy radiated from each slot 610 can be finely controlled so that detailed holographic diffraction patterns can be formed by the array of tunable slots.

In one embodiment, tunable slots in a row are spaced from each other by $\lambda/5$. Other spacings may be used. In one embodiment, each tunable slot in a row is spaced from the closest tunable slot in an adjacent row by $\lambda/2$, and, thus, commonly oriented tunable slots in different rows are spaced by $\lambda/4$, though other spacings are possible (e.g., $\lambda/5$, $\lambda/6.3$). In another embodiment, each tunable slot in a row is spaced from the closest tunable slot in an adjacent row by $\lambda/3$.

Embodiments of this invention use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015, to the multi-aperture needs of the marketplace.

Figure 9A:
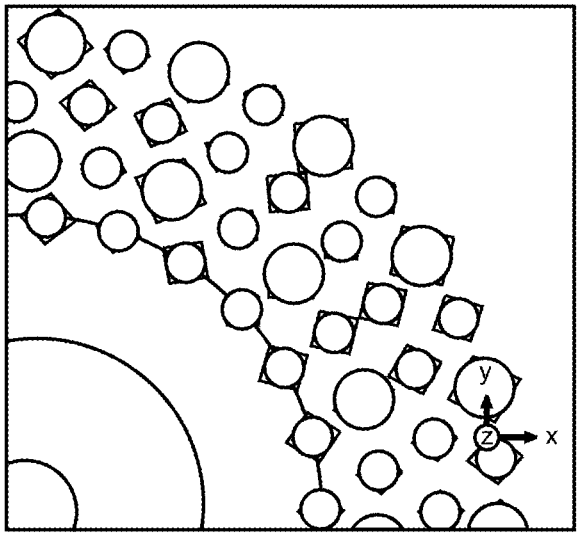
FIGS. 9A-9D illustrate one embodiment of the different layers for creating the slotted array.
Figure 9B:
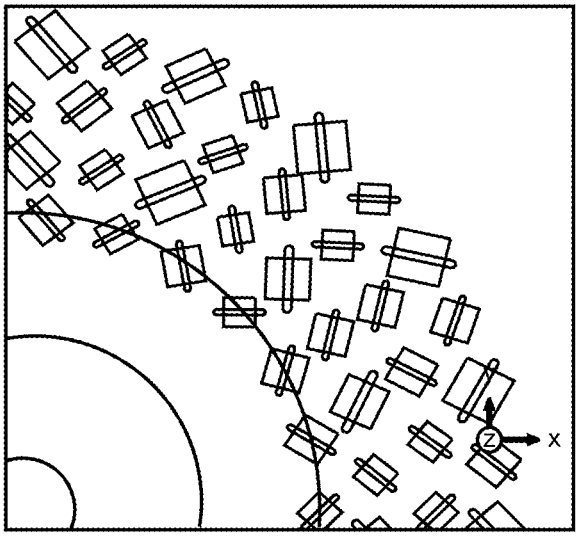
Figure 9C:
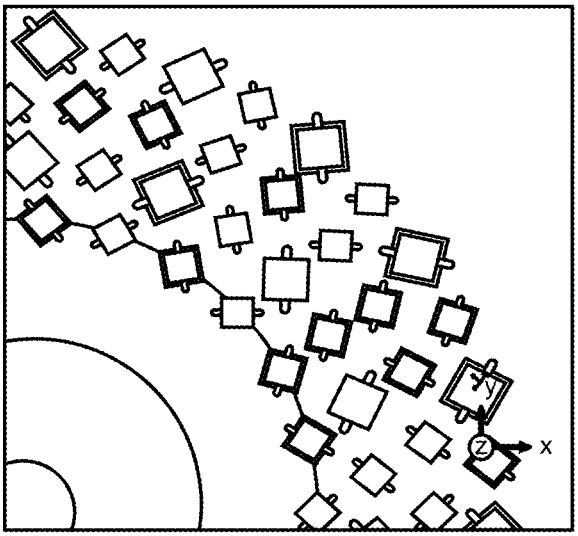
Figure 9D:
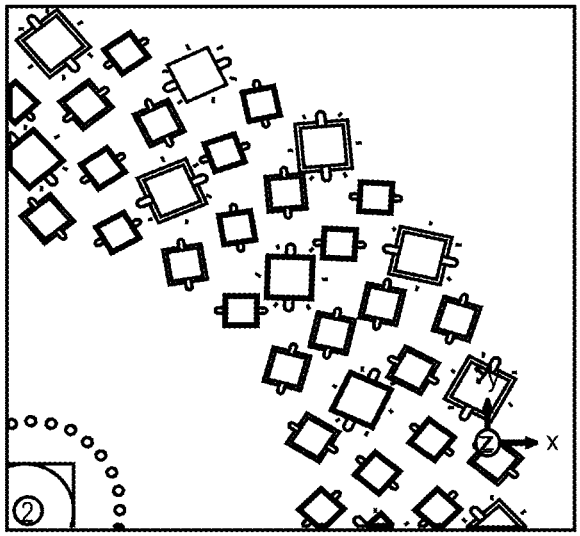

FIGS. 9A-9D illustrate one embodiment of the different layers for creating the slotted array. Some or all of the arrays variously shown in FIGS. 9A-9D may, for example, provide functionality of antenna panel 140 or other antenna structures described herein. Note that in this example the antenna array has two different types of antenna elements that are used for two different types of frequency bands. FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10A:
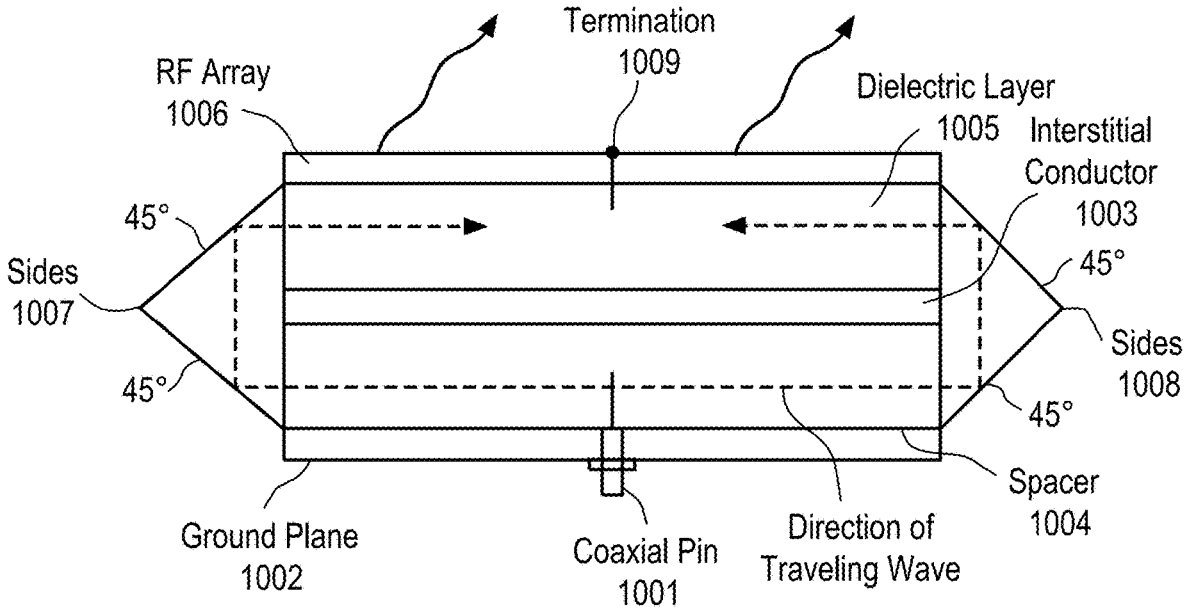
FIGS. 10A, 10B each illustrate a respective embodiment of the antenna system which is to produce an outgoing wave.

FIG. 10A illustrates a side view of one embodiment of a cylindrically fed antenna structure. The structures shown in FIG. 10A may, for example, provide functionality of antenna panel 140 or other antenna structures described herein. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10A includes the coaxial feed of FIG. 5.

Referring to FIG. 10A, a coaxial pin 1001 is used to excite the field on the lower level of the antenna. In one embodiment, coaxial pin 1001 is a 50Ω coax pin that is readily available. Coaxial pin 1001 is coupled (e.g., bolted) to the bottom of the antenna structure, which is conducting ground plane 1002.

Separate from conducting ground plane 1002 is interstitial conductor 1003, which is an internal conductor. In one embodiment, conducting ground plane 1002 and interstitial conductor 1003 are parallel to each other. In one embodiment, the distance between ground plane 1002 and interstitial conductor 1003 is 0.1-0.15". In another embodiment, this distance may be $\lambda/2$, where $\lambda$ is the wavelength of the travelling wave at the frequency of operation.

Ground plane 1002 is separated from interstitial conductor 1003 via a spacer 1004. In one embodiment, spacer 1004 is a foam or air-like spacer. In one embodiment, spacer 1004 comprises a plastic spacer.

On top of interstitial conductor 1003 is dielectric layer 1005. In one embodiment, dielectric layer 1005 is plastic. FIG. 10A illustrates an example of a dielectric material into which a feed wave is launched. The purpose of dielectric layer 1005 is to slow the travelling wave relative to free space velocity. In one embodiment, dielectric layer 1005 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric layer 1005, such as periodic sub-wavelength metallic structures that can be machined or lithographically defined, for example.

An RF-array 1006 is on top of dielectric layer 1005. In one embodiment, the distance between interstitial conductor 1003 and RF-array 1006 is 0.1-0.15". In another embodiment, this distance may be λ_eff/2, where λ_eff is the effective wavelength in the medium at the design frequency.

The antenna includes sides 1007 and 1008. Sides 1007 and 1008 are angled to cause a travelling wave feed from coax pin 1001 to be propagated from the area below interstitial conductor 1003 (the spacer layer) to the area above interstitial conductor 1003 (the dielectric layer) via reflection. In one embodiment, the angle of sides 1007 and 1008 are at 45° angles. In an alternative embodiment, sides 1007 and 1008 could be replaced with a continuous radius to achieve the reflection. While FIG. 10A shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level.

In operation, when a feed wave is fed in from coaxial pin 1001, the wave travels outward concentrically oriented from coaxial pin 1001 in the area between ground plane 1002 and interstitial conductor 1003. The concentrically outgoing waves are reflected by sides 1007 and 1008 and travel inwardly in the area between interstitial conductor 1003 and RF array 1006. The reflection from the edge of the circular perimeter causes the wave to remain in phase (i.e., it is an in-phase reflection). The travelling wave is slowed by dielectric layer 1005. At this point, the travelling wave starts interacting and exciting with elements in RF array 1006 to obtain the desired scattering.

To terminate the travelling wave, a termination 1009 is included in the antenna at the geometric center of the antenna. In one embodiment, termination 1009 comprises a pin termination (e.g., a 50Ω pin). In another embodiment, termination 1009 comprises an RF absorber that terminates unused energy to prevent reflections of that unused energy back through the feed structure of the antenna. These could be used at the top of RF array 1006.

Figure 10B:
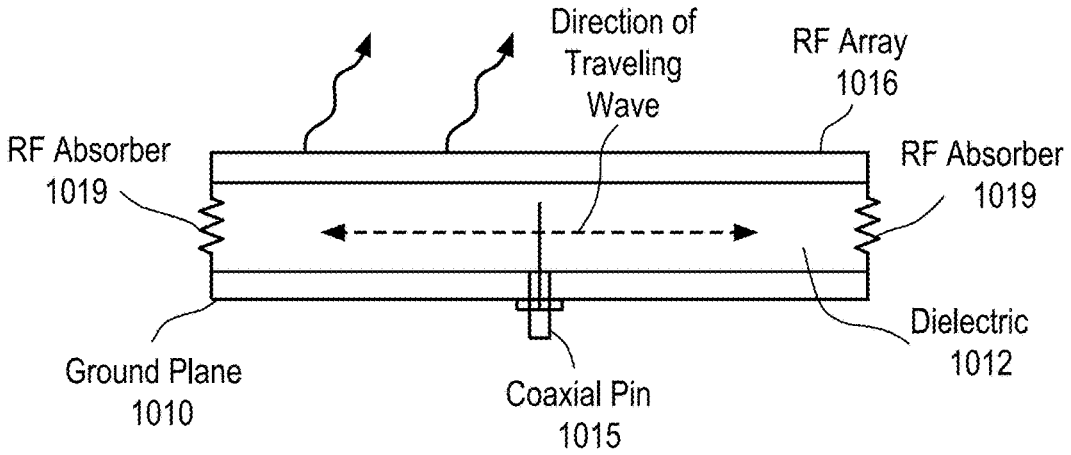

FIG. 10B illustrates another embodiment of the antenna system with an outgoing wave. The antenna system of FIG. 10B may, for example, provide functionality of antenna panel 140 or other antenna structures described herein. Referring to FIG. 10B, a ground plane 1010 may be substantially parallel to a dielectric layer 1012 (e.g., a plastic layer, etc.). RF absorbers 1019 (e.g., resistors) couple the ground plane 1010 to a RF array 1016 disposed on dielectric layer 1012. A coaxial pin 1015 (e.g., 50Ω) feeds the antenna.

In operation, a feed wave is fed through coaxial pin 1015 and travels concentrically outward and interacts with the elements of RF array 1016.

The cylindrical feed in both the antennas of FIGS. 10A and 10B improves the service angle of the antenna. Instead of a service angle of plus or minus forty five degrees azimuth (±45° Az) and plus or minus twenty five degrees elevation (±25° El), in one embodiment, the antenna system has a service angle of seventy five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

RF array 1006 of FIG. 10A and RF array 1016 of FIG. 10B include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Figure 21:
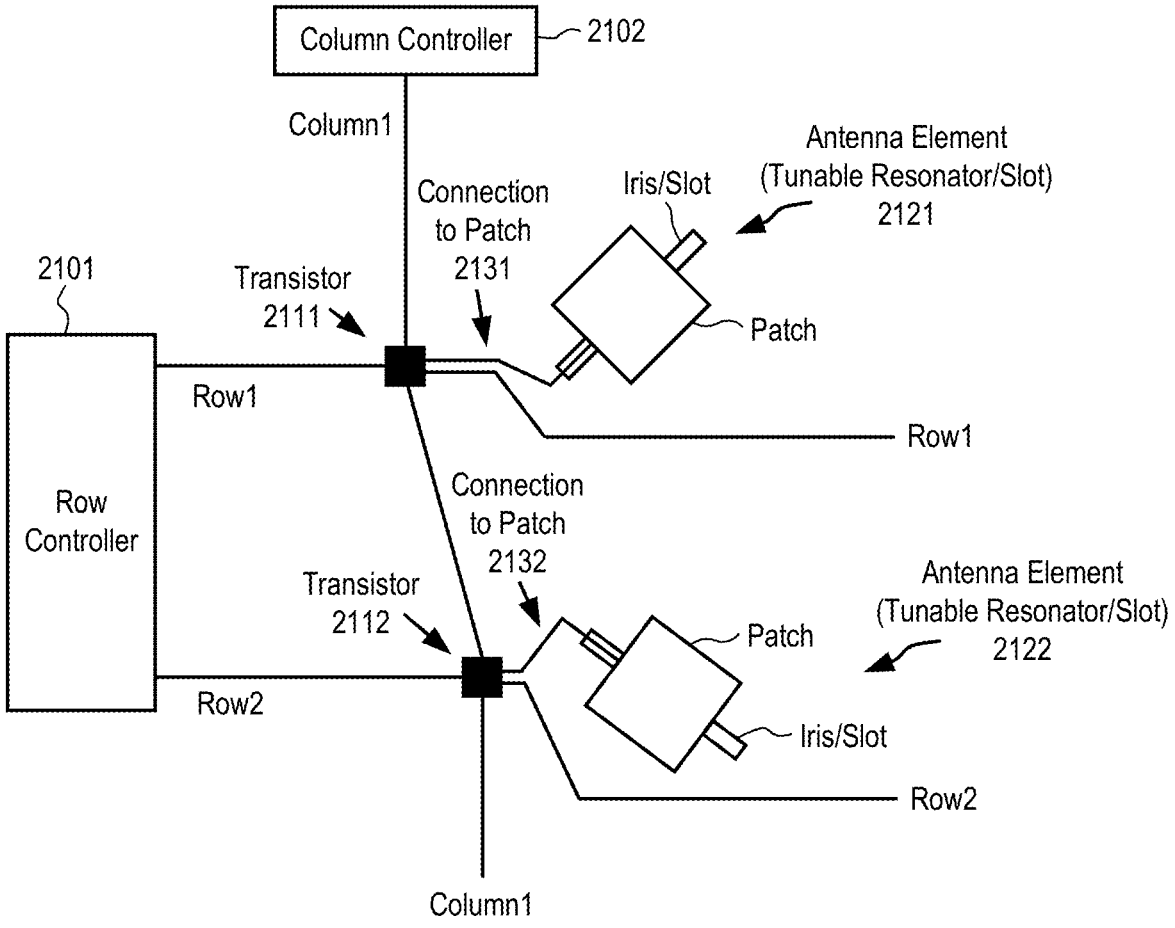
FIG. 21 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 21 illustrates one embodiment of the placement of matrix drive circuitry with respect to antenna elements. Referring to FIG. 21, row controller 2101 is coupled to transistors 2111 and 2112, via row select signals Row1 and Row2, respectively, and column controller 2102 is coupled to transistors 2111 and 2112 via column select signal Column1. Transistor 2111 is also coupled to antenna element 2121 via connection to patch 2131, while transistor 2112 is coupled to antenna element 2122 via connection to patch 2132.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercial available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 11:
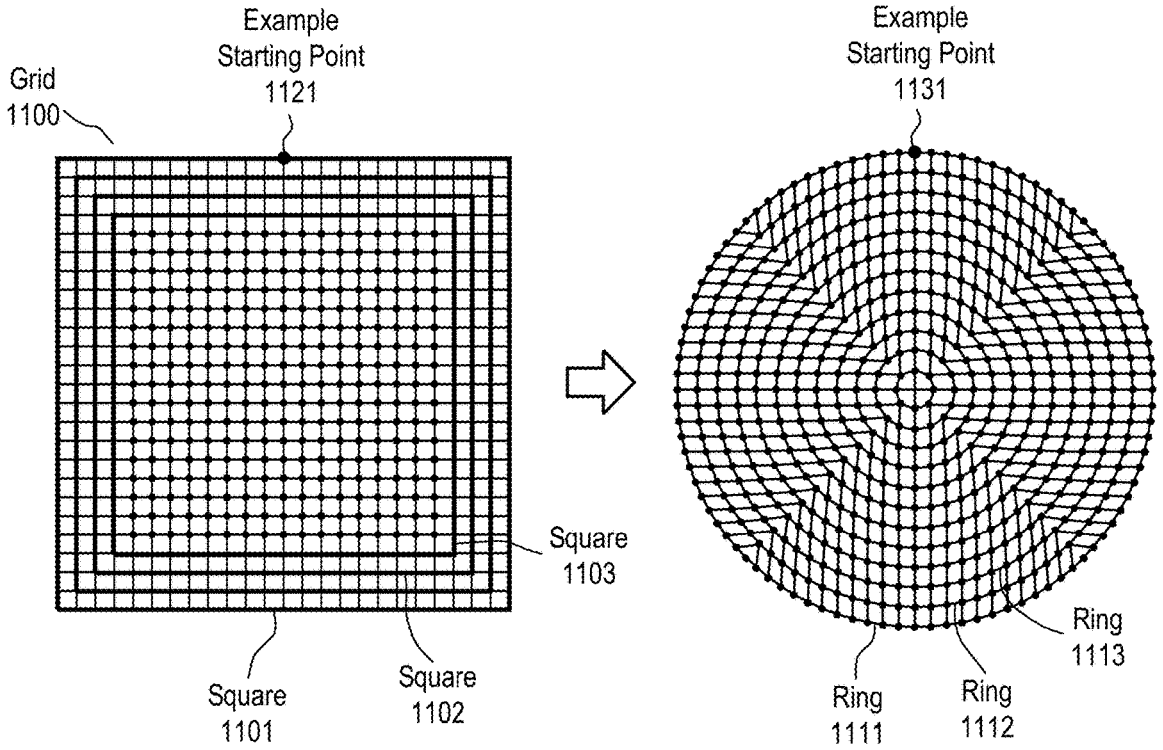
FIG. 11 shows an example where cells are grouped to form concentric squares (rectangles).

FIG. 11 shows an example where cells are grouped to form concentric squares (rectangles). Referring to FIG. 11, squares 1101-1103 are shown on the grid 1100 of rows and columns. Note that these are examples of the squares and not all of the squares to create the cell placement on the right side of FIG. 11. Each of the squares, such as squares 1101-1103, are then, through a mathematical conformal mapping process, transformed into rings, such as rings 1111-1113 of antenna elements. For example, the outer ring 1111 is the transformation of the outer square 1101 on the left.

The density of the cells after the transformation is determined by the number of cells that the next larger square contains in addition to the previous square. In one embodiment, using squares results in the number of additional antenna elements, ΔN, to be 8 additional cells on the next larger square. In one embodiment, this number is constant for the entire aperture. In one embodiment, the ratio of cellpitch1 (CP1: ring to ring distance) to cellpitch2 (CP2: distance cell to cell along a ring) is given by:

$$CP1/CP2=\Delta N/2\pi$$

Thus, CP2 is a function of CP1 (and vice versa). The cellpitch ratio for the example in FIG. 11 is then $$CP1/CP2=8/2\pi=1.2732$$

which means that the CP1 is larger than CP2.

In one embodiment, to perform the transformation, a starting point on each square, such as starting point 1121 on square 1101, is selected and the antenna element associated with that starting point is placed on one position of its corresponding ring, such as starting point 1131 on ring 1111. For example, the x-axis or y-axis may be used as the starting point. Thereafter, the next element on the square proceeding in one direction (clockwise or counterclockwise) from the starting point is selected and that element placed on the next location on the ring going in the same direction (clockwise or counterclockwise) that was used in the square. This process is repeated until the locations of all the antenna elements have been assigned positions on the ring. This entire square to ring transformation process is repeated for all squares.

Figure 12:
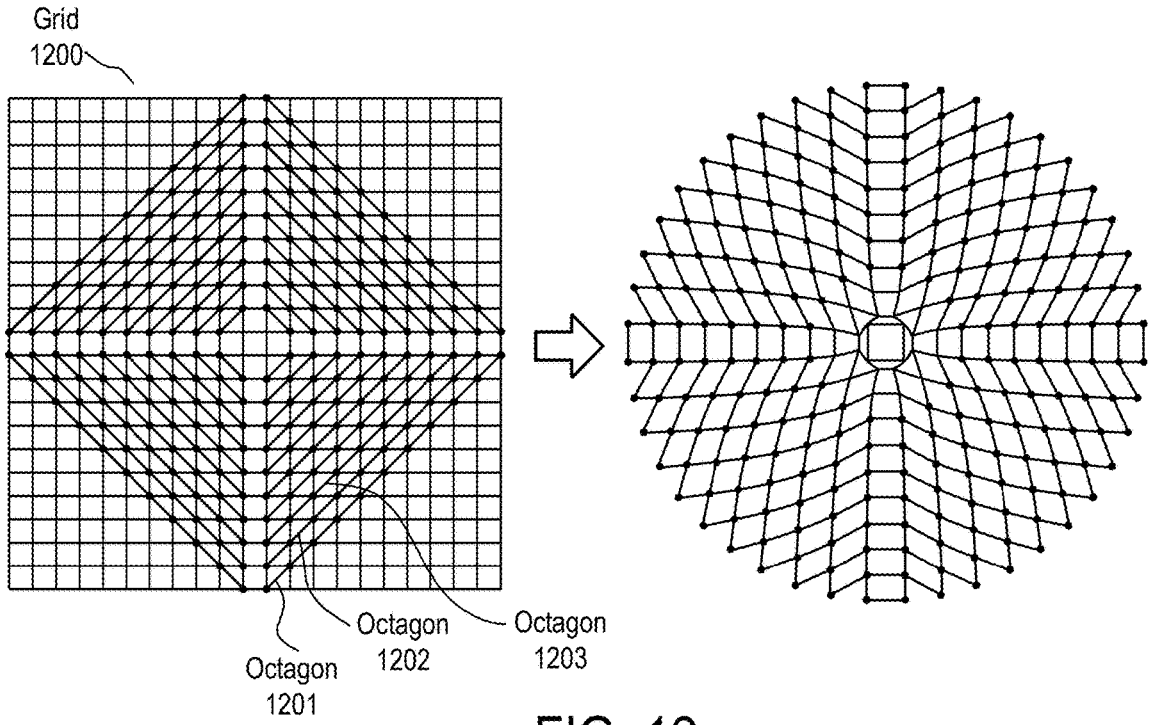
FIG. 12 shows an example where cells are grouped to form concentric octagons.

However, according to analytical studies and routing constraints, it is preferred to apply a CP2 larger than CP1. To accomplish this, a second strategy shown in FIG. 12 is used. Referring to FIG. 12, the cells are grouped initially into octagons, such as octagons 1201-1203, with respect to a grid 1200. By grouping the cells into octagons, the number of additional antenna elements ΔN equals 4, which gives a ratio:

$$CP1/CP2=4/2\pi=0.6366$$

which results in CP2>CP1.

The transformation from octagon to concentric rings for cell placement according to FIG. 12 can be performed in the same manner as that described above with respect to FIG. 11 by initially selecting a starting point.

Note that the cell placements disclosed with respect to FIGS. 11 and 12 may provide any of a number of features. Such features may include, for example, a constant CP1/CP2 over the entire aperture (although a CP1/CP2 which, for example, is 90% constant over an aperture may still function). Another such feature is CP2 being a function of CP1. Still another feature is a constant increase per ring in the number of antenna elements as the ring distance from the centrally located antenna feed increases. Still another feature is that cells may be connected to rows and columns of the matrix—e.g., wherein all cells have unique addresses. Alternatively or in addition, cells may be placed on concentric rings. Still another feature is that there may be rotational symmetry in that the four quadrants are identical and a ¼ wedge can be rotated to build out the array. Such rotational symmetry may be beneficial for segmented embodiments, for example. Note that while two shapes are given, other shapes may be used. Other increments are possible (e.g., 6 increments).

Figure 13:
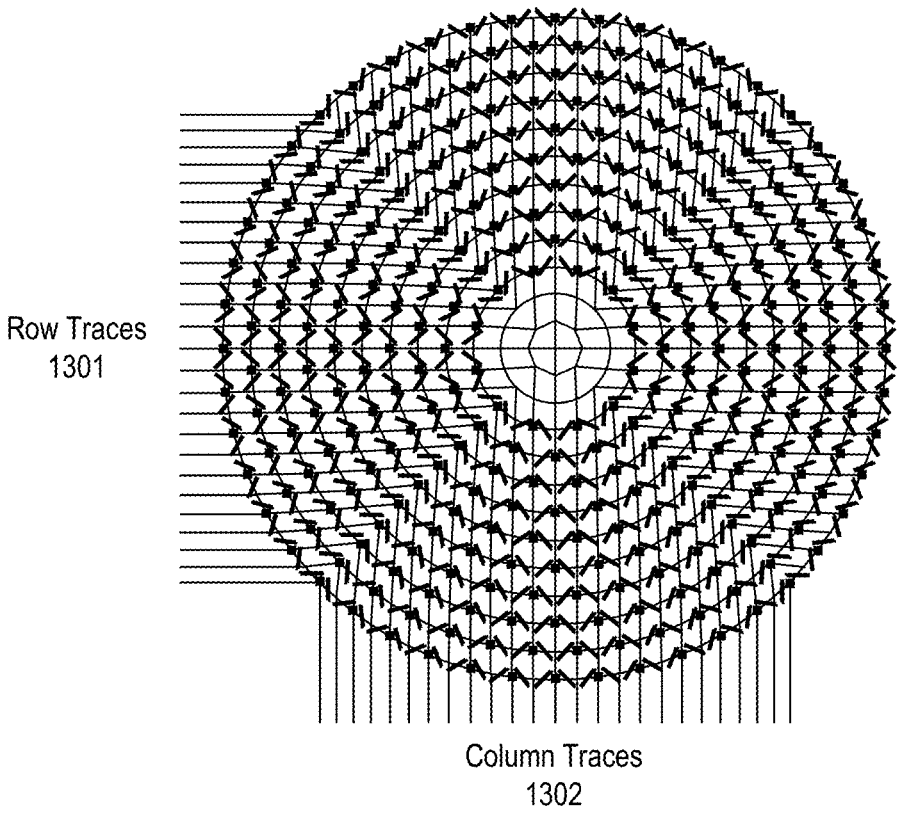
FIG. 13 shows an example of a small aperture including the irises and the matrix drive circuitry.

FIG. 13 shows an example of a small aperture including the irises and the matrix drive circuitry. The row traces 1301 and column traces 1302 represent row connections and column connections, respectively. These lines describe the matrix drive network and not the physical traces (as physical traces may have to be routed around antenna elements, or parts thereof). The square next to each pair of irises is a transistor.

FIG. 13 also shows the potential of the cell placement technique for using dual-transistors where each component drives two cells in a PCB array. In this case, one discrete device package contains two transistors, and each transistor drives one cell.

Figure 22:
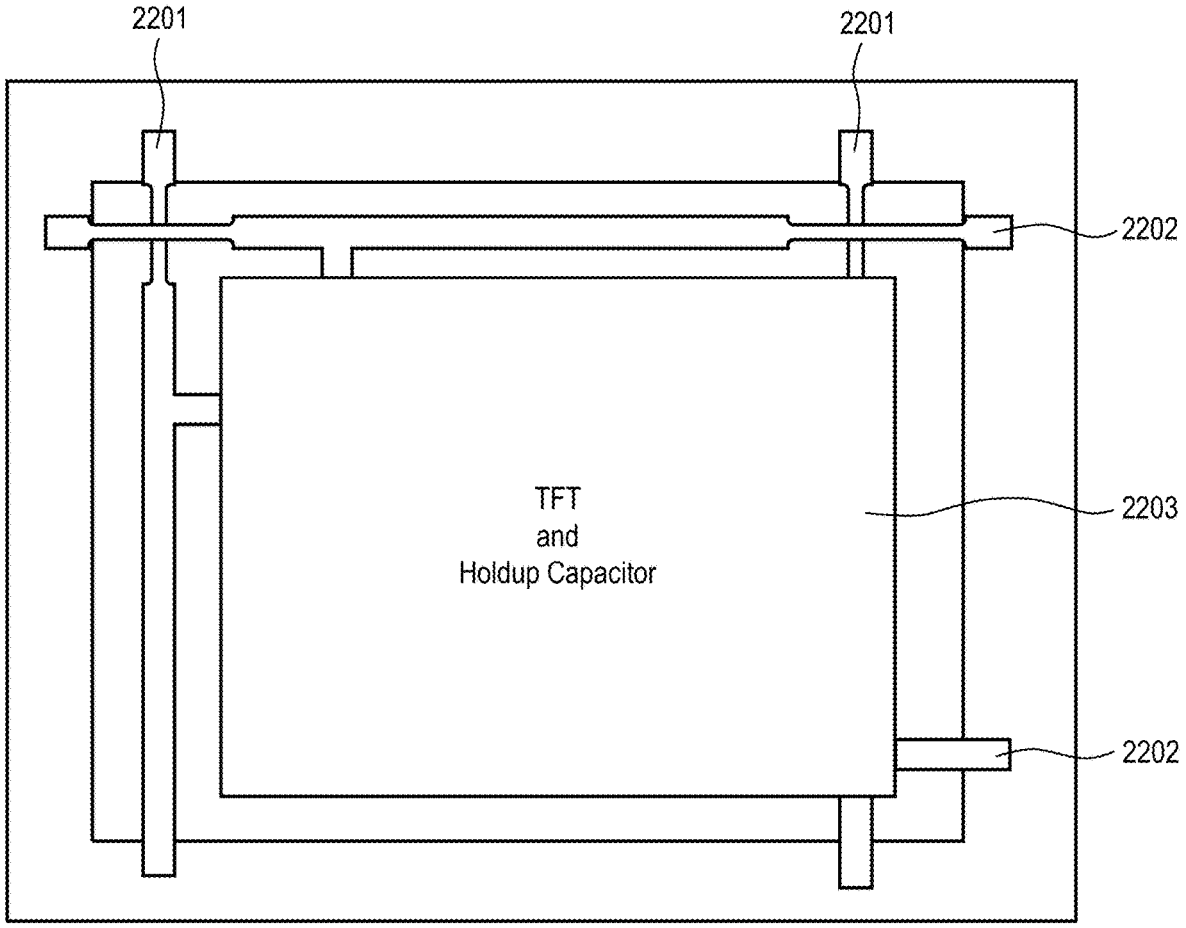
FIG. 22 illustrates one embodiment of a TFT package.

In one embodiment, a TFT package is used to enable placement and unique addressing in the matrix drive. FIG. 22 illustrates one embodiment of a TFT package. Referring to FIG. 22, a TFT and a hold capacitor 2203 is shown with input and output ports. There are two input ports connected to traces 2201 and two output ports connected to traces 2202 to connect the TFTs together using the rows and columns. In one embodiment, the row and column traces cross in 90° angles to reduce, and potentially minimize, the coupling between the row and column traces. In one embodiment, the row and column traces are on different layers.

Another important feature of the proposed cell placement shown in FIGS. 11-13 is that the layout is a repeating pattern in which each quarter of the layout is the same as the others. This allows the sub-section of the array to be repeated rotation-wise around the location of the central antenna feed, which in turn allows a segmentation of the aperture into sub-apertures. This helps in fabricating the antenna aperture.

In another embodiment, the matrix drive circuitry and cell placement on the cylindrical feed antenna is accomplished in a different manner. To realize matrix drive circuitry on the cylindrical feed antenna, a layout is realized by repeating a subsection of the array rotation-wise. This embodiment also allows the cell density that can be used for illumination tapering to be varied to improve the RF performance.

Figure 14:
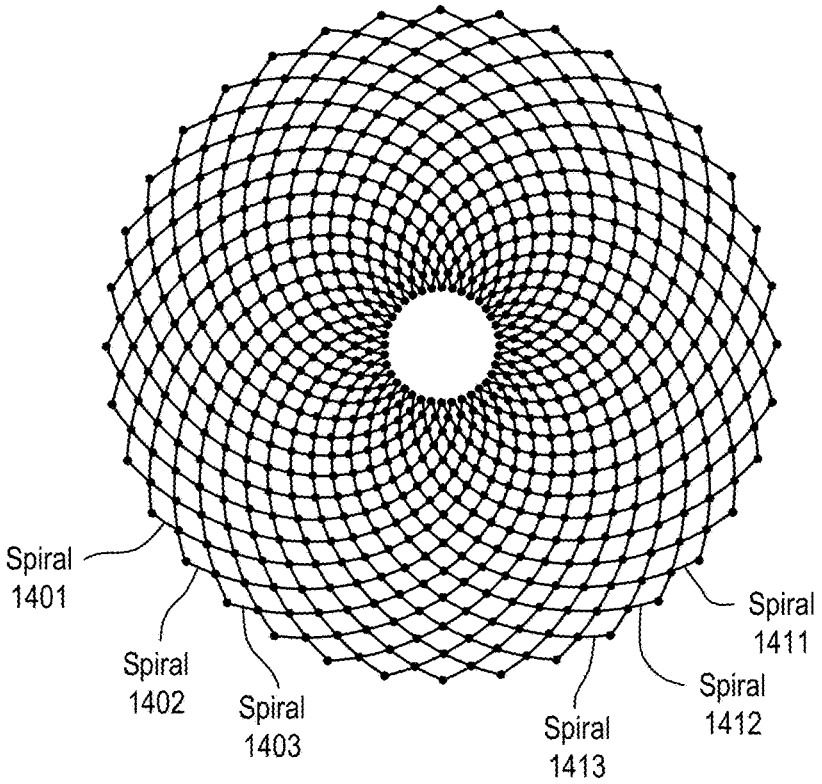
FIG. 14 shows an example of lattice spirals used for cell placement.

In this alternative approach, the placement of cells and transistors on a cylindrical feed antenna aperture is based on a lattice formed by spiral shaped traces. FIG. 14 shows an example of such lattice clockwise spirals, such as spirals 1401-1403, which bend in a clockwise direction and the spirals, such as spirals 1411-1413, which bend in a clockwise, or opposite, direction. The different orientation of the spirals results in intersections between the clockwise and counterclockwise spirals. The resulting lattice provides a unique address given by the intersection of a counterclockwise trace and a clockwise trace and can therefore be used as a matrix drive lattice. Furthermore, the intersections can be grouped on concentric rings, which is crucial for the RF performance of the cylindrical feed antenna.

Unlike the approaches for cell placement on the cylindrical feed antenna aperture discussed above, the approach discussed above in relation to FIG. 14 provides a non-uniform distribution of the cells. As shown in FIG. 14, the distance between the cells increases with the increase in radius of the concentric rings. In one embodiment, the varying density is used as a method to incorporate an illumination tapering under control of the controller for the antenna array.

Figure 15:
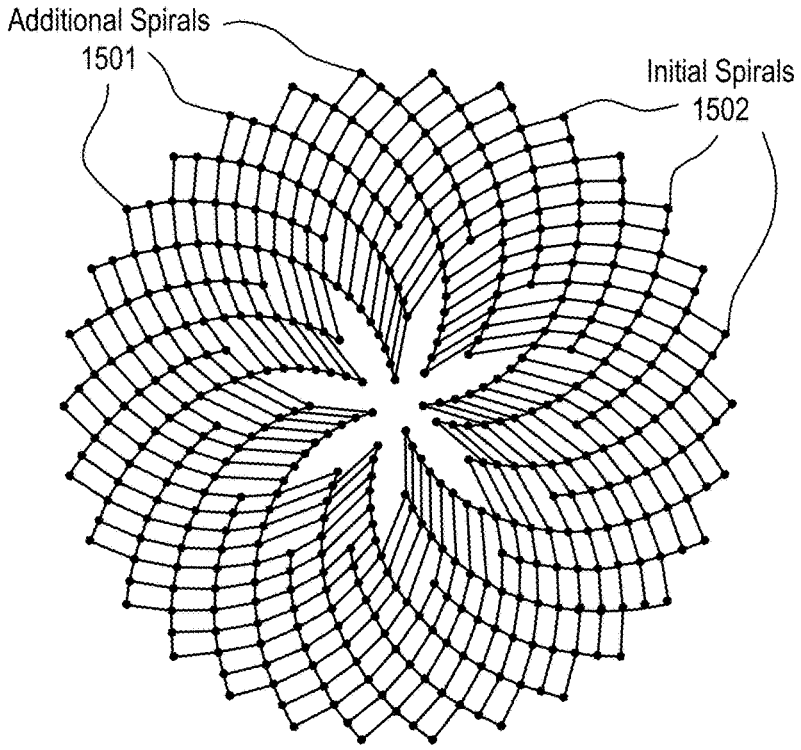
FIG. 15 shows an example of cell placement that uses additional spirals to achieve a more uniform density.

Due to the size of the cells and the required space between them for traces, the cell density cannot exceed a certain number. In one embodiment, the distance is $\lambda/5$ based on the frequency of operation. As described above, other distances may be used. In order to avoid an overpopulated density close to the center, or in other words to avoid an under-population close to the edge, additional spirals can be added to the initial spirals as the radius of the successive concentric rings increases. FIG. 15 shows an example of cell placement that uses additional spirals to achieve a more uniform density. Referring to FIG. 15, additional spirals, such as additional spirals 1501, are added to the initial spirals, such as spirals 1502, as the radius of the successive concentric rings increases. According to analytical simulations, this approach provides an RF performance that converges the performance of an entirely uniform distribution of cells. Note that this design provides a better sidelobe behavior because of the tapered element density than some embodiments described above.

Figure 16:
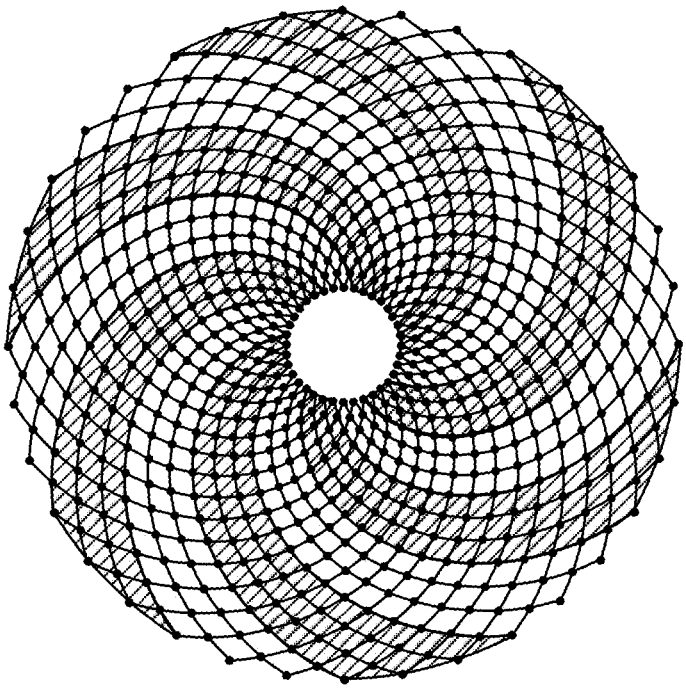
FIG. 16 illustrates a selected pattern of spirals that is repeated to fill the entire aperture.

Another advantage of the use of spirals for cell placement is the rotational symmetry and the repeatable pattern which can simplify the routing efforts and reducing fabrication costs. FIG. 16 illustrates a selected pattern of spirals that is repeated to fill the entire aperture. Note that the cell placements disclosed with respect to FIGS. 14-16 have a number of features. One such feature is that CP1/CP2 is not constant over the entire aperture. Another feature is that CP2 may be a function of CP1. Still another feature is that there may be no increase per ring in the number of antenna elements as the ring distance from the centrally located antenna feed increases. Still another feature is that some or all cells may not be connected to rows and columns of the matrix. Other such features are that some or all cells may have unique addresses, that cells may be positioned on concentric rings and/or that there may be rotational symmetry. Thus, the cell placement embodiments described above in conjunction with FIGS. 14-16 have many similar features to the cell placement embodiments described above in conjunction with FIGS. 11-13. Some or all of the cell arrangements variously shown in FIGS. 11-16 may, for example, provide functionality of antenna panel 140 or other antenna structures described herein.

In one embodiment, the antenna aperture is created by combining multiple segments of antenna elements together. This requires that the array of antenna elements be segmented and the segmentation ideally requires a repeatable footprint pattern of the antenna. In one embodiment, the segmentation of a cylindrical feed antenna array occurs such that the antenna footprint does not provide a repeatable pattern in a straight and inline fashion due to the different rotation angles of each radiating element. One goal of the segmentation approach disclosed herein is to provide segmentation without compromising the radiation performance of the antenna.

While segmentation techniques described herein focuses improving, and potentially maximizing, the surface utilization of industry standard substrates with rectangular shapes, the segmentation approach is not limited to such substrate shapes.

In one embodiment, segmentation of a cylindrical feed antenna is performed in a way that the combination of four segments realize a pattern in which the antenna elements are placed on concentric and closed rings. This aspect is important to maintain the RF performance. Furthermore, in one embodiment, each segment requires a separate matrix drive circuitry.

Figure 17:
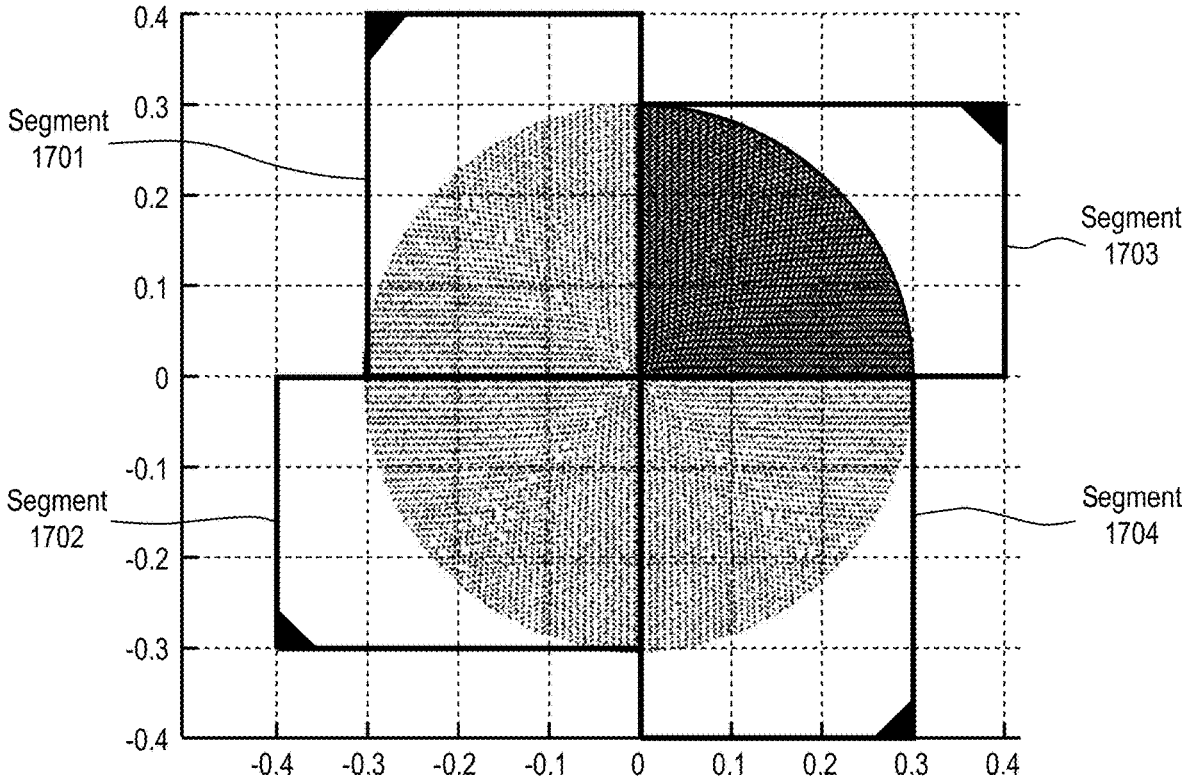
FIG. 17 illustrates one embodiment of segmentation of a cylindrical feed aperture into quadrants.

FIG. 17 illustrates segmentation of a cylindrical feed aperture into quadrants. Referring to FIG. 17, segments 1701-1704 are identical quadrants that are combined to build a round antenna aperture. The antenna elements on each of segments 1701-1704 are placed in portions of rings that form concentric and closed rings when segments 1701-1704 are combined. To combine the segments, segments will be mounted or laminated to a carrier. In another embodiment, overlapping edges of the segments are used to combine them together. In this case, in one embodiment, a conductive bond is created across the edges to prevent RF from leaking. Note that the element type is not affected by the segmentation.

As the result of this segmentation method illustrated in FIG. 17, the seams between segments 1701-1704 meet at the center and go radially from the center to the edge of the antenna aperture. This configuration is advantageous since the generated currents of the cylindrical feed propagate radially and a radial seam has a low parasitic impact on the propagated wave.

Figure 18A:
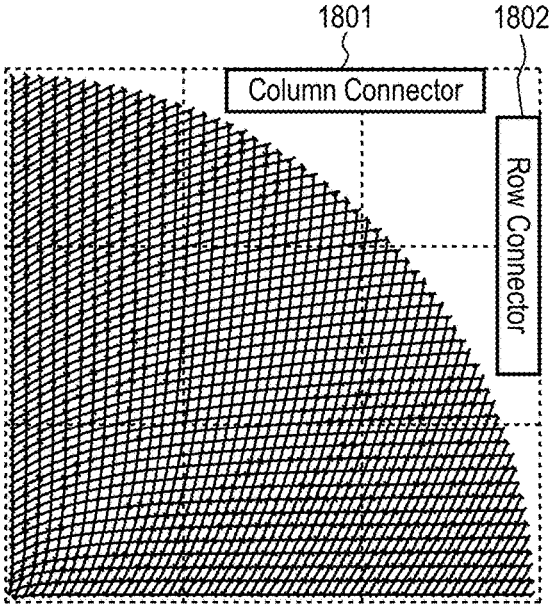
FIGS. 18A and 18B illustrate a single segment of FIG. 17 with the applied matrix drive lattice.
Figure 18B:
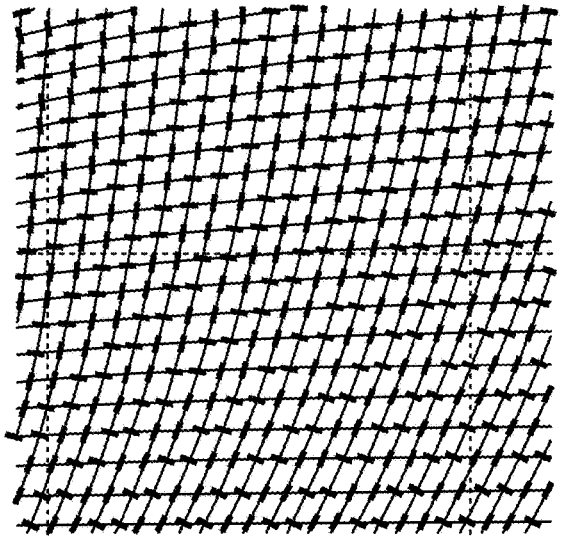

As shown in FIG. 17, rectangular substrates, which are a standard in the LCD industry, can also be used to realize an aperture. FIGS. 18A and 18B illustrate a single segment of FIG. 17 with the applied matrix drive lattice. The matrix drive lattice assigns a unique address to each of transistor. Referring to FIGS. 18A and 18B, a column connector 1801 and row connector 1802 are coupled to drive lattice lines. FIG. 18B also shows irises coupled to lattice lines.

Figure 19:
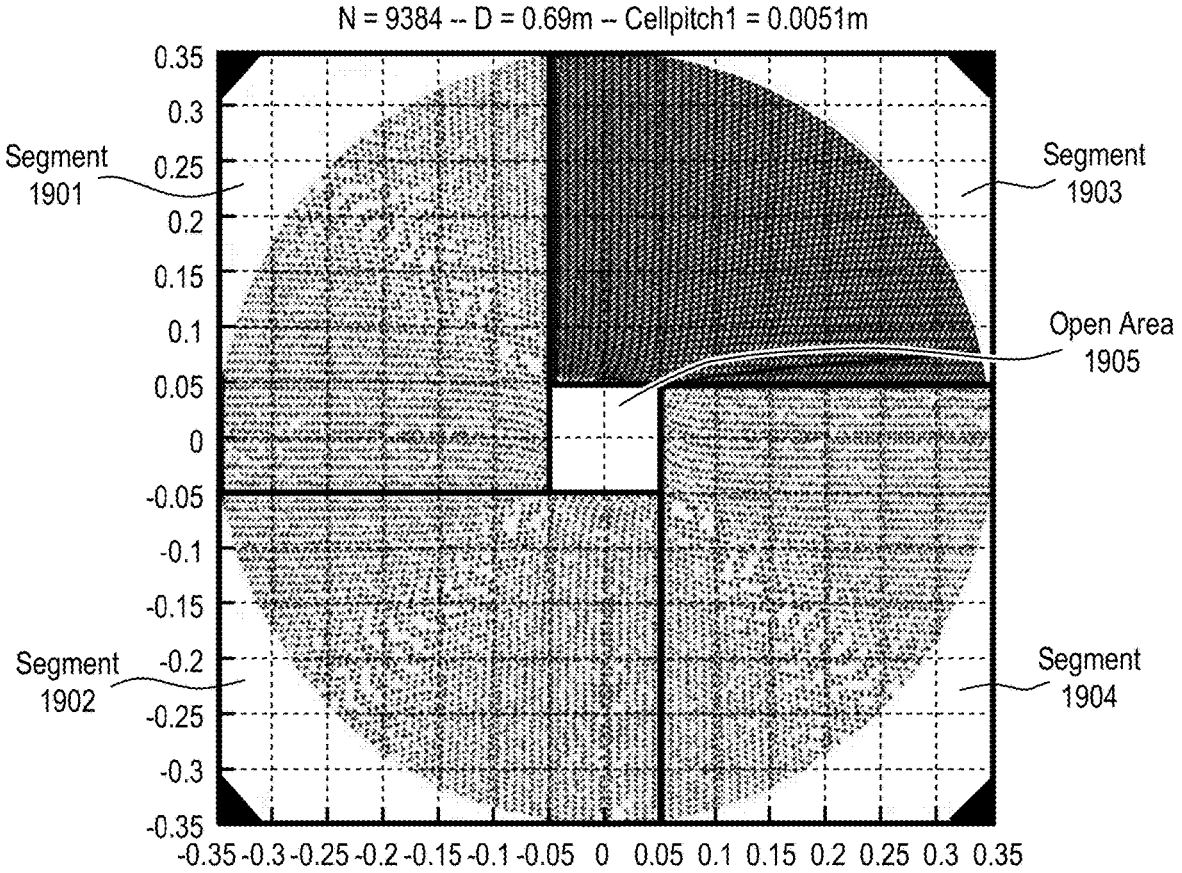
FIG. 19 illustrates another embodiment of segmentation of a cylindrical feed aperture into quadrants.

As is evident from FIG. 17, a large area of the substrate surface cannot be populated if a non-square substrate is used. In order to have a more efficient usage of the available surface on a non-square substrate, in another embodiment, the segments are on rectangular boards but utilize more of the board space for the segmented portion of the antenna array. One example of such an embodiment is shown in FIG. 19. Referring to FIG. 19, the antenna aperture is created by combining segments 1901-1904, which comprises substrates (e.g., boards) with a portion of the antenna array included therein. While each segment does not represent a circle quadrant, the combination of four segments 1901-1904 closes the rings on which the elements are placed. That is, the antenna elements on each of segments 1901-1904 are placed in portions of rings that form concentric and closed rings when segments 1901-1904 are combined. In one embodiment, the substrates are combined in a sliding tile fashion, so that the longer side of the non-square board introduces a rectangular keep-out area, referred to as open area 1905. Open area 1905 is where the centrally located antenna feed is located and included in the antenna.

The antenna feed is coupled to the rest of the segments when the open area exists because the feed comes from the bottom, and the open area can be closed by a piece of metal to prevent radiation from the open area. A termination pin may also be used. The use of substrates in this fashion allows use of the available surface area more efficiently and results in an increased aperture diameter.

Figure 20A:
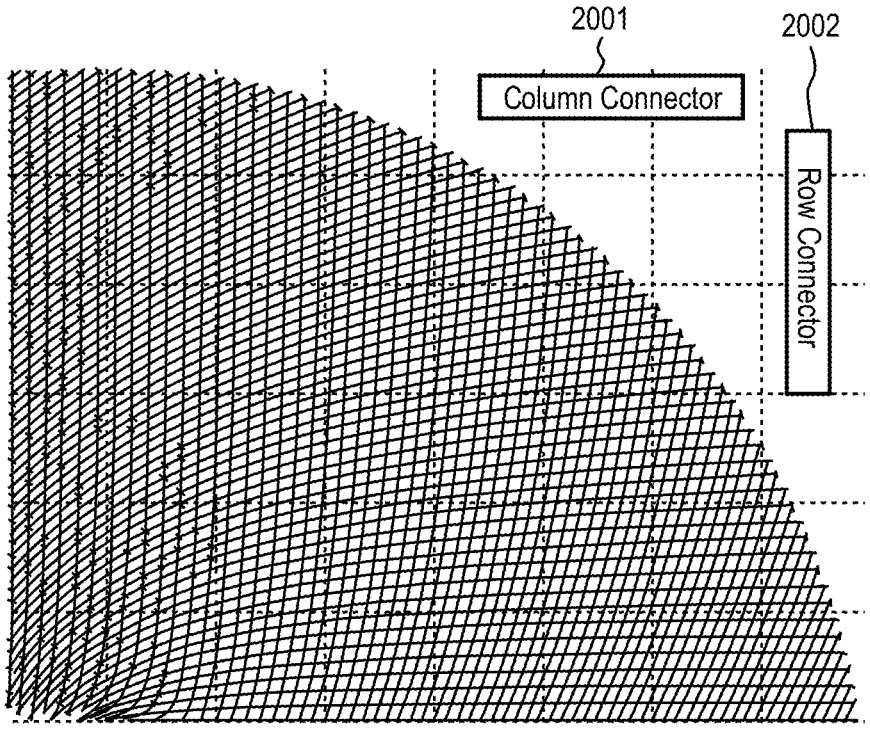
FIGS. 20A and 20B illustrate a single segment of FIG. 19 with the applied matrix drive lattice.
Figure 20B:
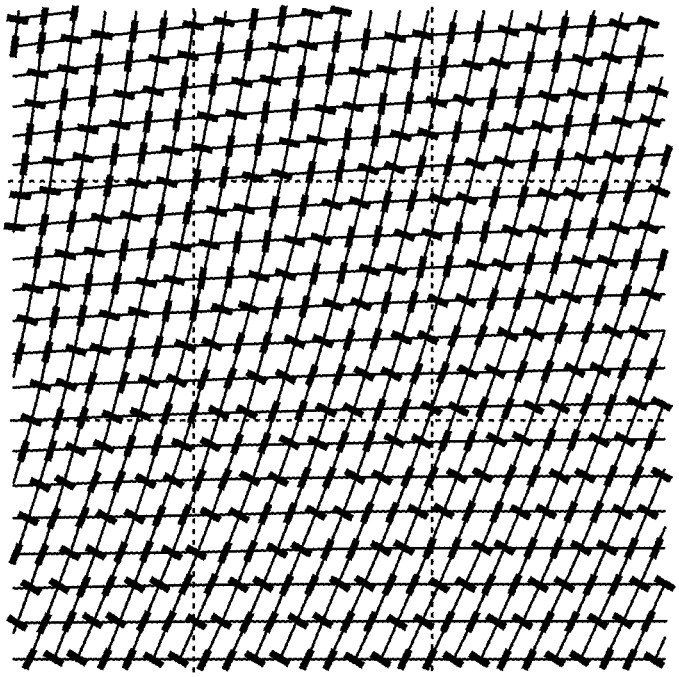

Similar to the embodiment shown in FIGS. 17, 18A and 18B, this embodiment allows use of a cell placement strategy to obtain a matrix drive lattice to cover each cell with a unique address. FIGS. 20A and 20B illustrate a single segment of FIG. 19 with the applied matrix drive lattice. The matrix drive lattice assigns a unique address to each of transistor. Referring to FIGS. 20A and 20B, a column connector 2001 and row connector 2002 are coupled to drive lattice lines. FIG. 20B also shows irises. Some or all of the structures variously shown in FIGS. 17, 18A, 18B, 19, 20A and 20B may, for example, provide functionality of antenna panel 140 or other antenna structures described herein.

For both approaches described above, the cell placement may be performed based on a recently disclosed approach which allows the generation of matrix drive circuitry in a systematic and predefined lattice, as described above.

Figure 23A:
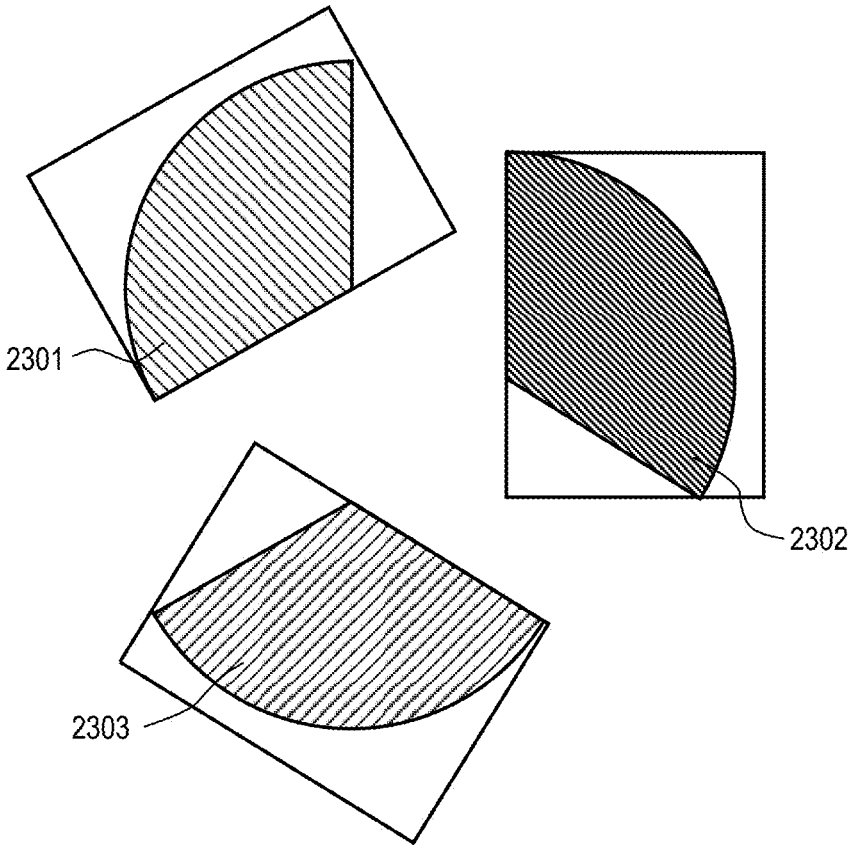
FIGS. 23A and 23B illustrate one example of an antenna aperture with an odd number of segments.
Figure 23B:
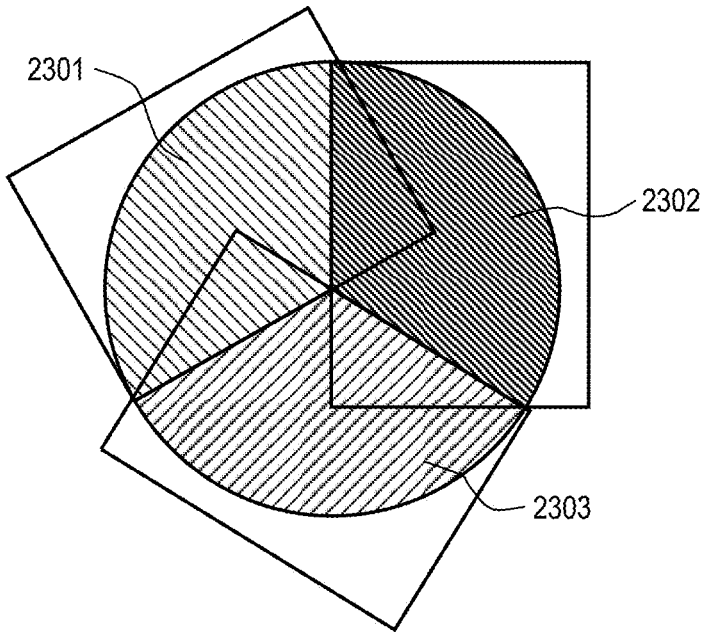

While the segmentations of the antenna arrays above are into four segments, this is not a requirement. The arrays may be divided into an odd number of segments, such as, for example, three segments or five segments. FIGS. 23A and 23B illustrate one example of an antenna aperture with an odd number of segments. Some or all of the segmented structures variously shown in FIGS. 23A and 23B may, for example, provide functionality of antenna panel 140 or other antenna structures described herein. Referring to FIG. 23A, there are three segments, segments 2301-2303, that are not combined. Referring to FIG. 23B, the three segments, segments 2301-2303, when combined, form the antenna aperture. These arrangements are not advantageous because the seams of all the segments do not go all the way through the aperture in a straight line. However, they do mitigate sidelobes.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

Figure 24:
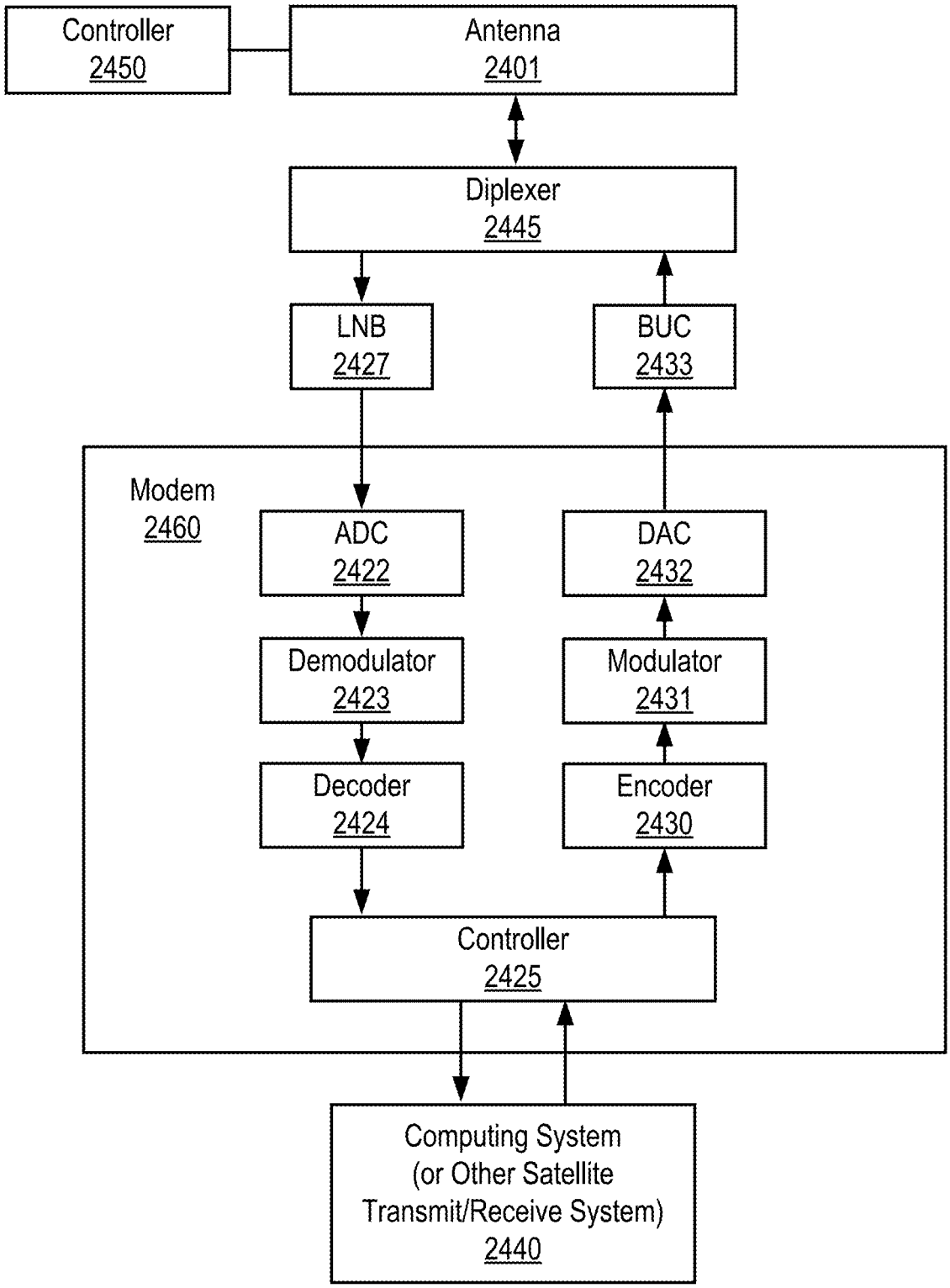
FIG. 24 is a block diagram illustrating features of a communication system according to an embodiment.

FIG. 24 is a block diagram of a communication system having transmit and receive paths according to an embodiment. The communication system of FIG. 24 may include features of one of communication devices 100, 450 and/or features shown in stages 300-307, for example. While one transmit path and one receive path are shown, the communication system may include only one of a receive path and a transmit path or, alternatively, may include more than one transmit path and/or more than one receive path.

Referring to FIG. 24, antenna 2401 includes one or more antenna panels operable to transmit and receive satellite communications—e.g., simultaneously at different respective frequencies. In one embodiment, antenna 2401 is coupled to diplexer 2445. The coupling may be by one or more feeding networks. In the case of a radial feed antenna, diplexer 2445 may combine the two signals—e.g., wherein a connection between antenna 2401 and diplexer 2445 includes a single broad-band feeding network that can carry both frequencies.

Diplexer 2445 may be coupled to a low noise block down converter (LNBs) 2427 to perform a noise filtering function and a down conversion and amplification function—e.g., including operations adapted from techniques known in the art. In one embodiment, LNB 2427 is in an out-door unit (ODU). In another embodiment, LNB 2427 is integrated into the antenna apparatus. LNB 2427 may be coupled to a modem 2460, which may be further coupled to computing system 2440 (e.g., a computer system, modem, etc.). Computing system 2440 is one example of hardware that may provide a user with some output which is based on—and/or some input which is to determine—signals communicated with antenna 2401. For example, computing system 2440 may include or couple to a display device which is to generate a display based on signal communication via antenna 2401.

Modem 2460 may include an analog-to-digital converter (ADC) 2422, which may be coupled to LNB 2427, to convert the received signal output from diplexer 2445 into digital format. Once converted to digital format, the signal may be demodulated by demodulator 2423 and decoded by decoder 2424 to obtain the encoded data on the received wave. The decoded data may then be sent to controller 2425, which sends it to computing system 2440.

Modem 2460 may additionally or alternatively include an encoder 2430 that encodes data to be transmitted from computing system 2440. The encoded data may be modulated by modulator 2431 and then converted to analog by digital-to-analog converter (DAC) 2432. The analog signal may then be filtered by a BUC (up-convert and high pass amplifier) 2433 and provided to one port of diplexer 2445. In one embodiment, BUC 2433 is in an out-door unit (ODU). Diplexer 2445 may support operations adapted from conventional interconnect techniques to provide the transmit signal to antenna 2401 for transmission.

Controller 2450 may control antenna 2401, including controller 2450 transmitting signals to configure beam steering, beamforming, frequency tuning and/or other operational characteristics of one or more antenna elements. Note that the full duplex communication system shown in FIG. 24 has a number of applications, including but not limited to, internet communication, vehicle communication (including software updating), etc.

Techniques and architectures for providing satellite communication mechanisms are described herein. In the above description, for purposes of explanation, numerous specific details are set forth in order to provide a thorough understanding of certain embodiments. It will be apparent, however, to one skilled in the art that certain embodiments can be practiced without these specific details. In other instances, structures and devices are shown in block diagram form in order to avoid obscuring the description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed description herein are presented in terms of algorithms and symbolic representations of operations on data bits within a computer memory. These algorithmic descriptions and representations are the means used by those skilled in the computing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Certain embodiments also relate to apparatus for performing the operations herein. This apparatus may be specially constructed for the required purposes, or it may comprise a general purpose computer selectively activated or reconfigured by a computer program stored in the computer. Such a computer program may be stored in a non-transitory computer readable storage medium, such as, but is not limited to, any type of disk including floppy disks, optical disks, CD-ROMs, and magnetic-optical disks, read-only memories (ROMs), random access memories (RAMs) such as dynamic RAM (DRAM), EPROMs, EEPROMs, magnetic or optical cards, or any type of media suitable for storing electronic instructions, and coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description herein. In addition, certain embodiments are not described with reference to any particular programming language. It will be appreciated that a variety of programming languages may be used to implement the teachings of such embodiments as described herein.

Besides what is described herein, various modifications may be made to the disclosed embodiments and implementations thereof without departing from their scope. Therefore, the illustrations and examples herein should be construed in an illustrative, and not a restrictive sense. The scope of the invention should be measured solely by reference to the claims that follow.

What is claimed is:

1. An apparatus comprising:

a radome;

a first foam layer including a first side and a second side opposite the first side, wherein the first foam layer is adhered to the radome via the second side;

an electronically steerable antenna panel coupled to the first foam layer via the first side, the electronically steerable antenna panel configured to participate in a communication of signals which are to propagate through the radome and through the first foam layer;

a base structure to support the antenna panel, wherein the antenna panel is disposed between the base structure and the radome;

a radio-frequency (RF) feed structure; and a plurality of posts around a periphery of the antenna panel and coupled to the radome, the plurality of posts to operate as standoffs that extend from the radome and abut a surface of the base structure to maintain a parallel spacing of the antenna panel above the RF feed structure.

2. The apparatus of claim 1, wherein the first side forms a first machined surface of the first foam layer.

3. The apparatus of claim 1, further comprising:

a second foam layer disposed between the antenna panel and the first foam layer, wherein a side of the second foam layer forms a second machined surface.

4. The apparatus of claim 1, wherein the first foam layer is adhered to the radome with a pressure sensitive adhesive material.

5. A method comprising:

forming a first foam layer which is disposed on a radome, the first foam layer including a first side and a second side opposite the first side; and while the first foam layer is adhered to the radome, coupling an electronically steerable antenna panel to the first foam layer via the first side, wherein coupling the electronically steerable antenna panel includes positioning the radome and the first foam layer onto a base structure while the antenna panel is disposed on the base structure, the positioning including abutting a surface of a plurality of posts around a periphery of the antenna panel with the base structure, wherein the posts of the plurality of posts are coupled to and extend from the radome and are operable to maintain a parallel spacing of the antenna panel above an RF feed structure and to facilitate alignment and positioning of the radome with respect to the base structure.

6. The method of claim 5, wherein forming the first foam layer includes:

depositing a foam material on the radome; and after the depositing, machining the foam material to form a first machined surface at the first side of the first foam layer.

7. The method of claim 5, further comprising:

forming a second foam layer coupled to the radome via the first foam layer, wherein a side of the second foam layer forms a second machined surface, and wherein the coupling the electronically steerable antenna panel includes coupling the electronically steerable antenna panel to the first foam layer via the second machined surface.

8. The method of claim 5, further comprising adhering the second side of the first foam layer to the radome with a pressure sensitive adhesive material.

9. A system comprising a communication device including:

a radome;

a first foam layer including a first side and a second side opposite the first side, wherein the first foam layer is adhered to the radome via the second side; and an electronically steerable antenna panel coupled to the first foam layer via the first side, the electronically steerable antenna panel configured to participate in a communication of signals which are to propagate through the radome and through the first foam layer, the antenna panel having an iris metal plane and a patch metal plane;

a base structure to support the antenna panel, wherein the antenna panel is disposed between the base structure and the radome;

a radio-frequency (RF) feed structure;

a plurality of posts around a periphery of the antenna panel and coupled to the radome, the plurality of posts to operate as standoffs that extend from the radome and abut a surface of the base structure to maintain a parallel spacing of the antenna panel above the RF feed structure; and a display device coupled to the communication device, the display device to display an image based on the communication of signals.

10. The apparatus of claim 9, wherein the first side forms a first machined surface of the first foam layer.

11. The system of claim 9, the communication device further comprising:

a second foam layer disposed between the antenna panel and the first foam layer, wherein a side of the second foam layer forms a second machined surface.

12. The system of claim 9, wherein the first foam layer is adhered to the radome with a pressure sensitive adhesive material.

* * * * *